US005970280A

United States Patent [19]

Suzuki et al.

[11] Patent Number: 5,970,280

[45] Date of Patent: Oct. 19, 1999

[54] IMAGE FORMING APPARATUS HAVING A DEVELOPING BIAS CONTROL UNIT

[75] Inventors: Hirokatsu Suzuki, Chiba; Hisashi Shoji, Kanagawa, both of Japan

[73] Assignee: Ricoh Company, Ltd., Tokyo, Japan

[21] Appl. No.: 09/154,499

[22] Filed: Sep. 17, 1998

[30] Foreign Application Priority Data

Sep. 18, 1997 [JP] Japan ..... 9-253891
Aug. 24, 1998 [JP] Japan ..... 10-237544

[51] Int. Cl.[6] ..... G03G 15/06

[52] U.S. Cl. ..... 399/55; 399/235; 399/270; 399/285

[58] Field of Search ..... 399/29, 55, 285, 399/270, 254, 234, 235

[56] References Cited

U.S. PATENT DOCUMENTS

| | | | |
|---|---|---|---|
| 5,600,415 | 2/1997 | Takahashi | 399/55 |
| 5,771,423 | 6/1998 | Hama | 399/55 |
| 5,778,279 | 7/1998 | Kawai et al. | 399/29 X |
| 5,862,442 | 1/1999 | Ahn | 399/254 X |

FOREIGN PATENT DOCUMENTS

| | | |
|---|---|---|
| 56-14266 | 2/1981 | Japan . |
| 63-136063 | 6/1988 | Japan . |
| 1-170969 | 7/1989 | Japan . |
| 2-58069 | 2/1990 | Japan . |
| 3-24569 | 2/1991 | Japan . |
| 3-293379 | 12/1991 | Japan . |
| 4-199073 | 7/1992 | Japan . |
| 5-333673 | 12/1993 | Japan . |
| 8-44177 | 2/1996 | Japan . |
| 8-160724 | 6/1996 | Japan . |
| 8-171269 | 7/1996 | Japan . |
| 9-258534 | 10/1997 | Japan . |

*Primary Examiner*—Matthew S. Smith
*Attorney, Agent, or Firm*—Oblon, Spivak, McClelland, Maier & Neustadt, P.C.

[57] ABSTRACT

An image forming apparatus includes an image support which supports an electrostatic latent image on a surface of the image support. A developing unit has a developing agent support which retains a developing agent, including a toner and carriers, contained in the developing unit. The developing unit converts the latent image on the image support into a toner image by causing the toner to adhere to the surface of the image support. A developing bias supplying unit supplies a developing bias voltage to the developing agent support of the developing unit, the developing bias voltage being one of a DC bias voltage and an AC bias voltage. A timer measures a non-driven period of the developing agent in the developing unit. A control unit selects one of the DC bias voltage and the AC bias voltage from the developing bias supplying unit based on the non-driven period measured by the timer, and controls the developing bias voltage at an output of the developing bias supplying unit such that the selected one of the DC bias voltage and the AC bias voltage is supplied to the developing agent support.

10 Claims, 12 Drawing Sheets

IMAGE FORMING APPARATUS HAVING A DEVELOPING BIAS CONTROL UNIT

BACKGROUND OF THE INVENTION (1) Field of the Invention

The present invention relates to an image forming apparatus, such as a copier, a printer or a facsimile, which is provided with a two-component developing unit.

(2) Description of the Related Art

An image forming apparatus provided with a two-component developing unit is known, and such a developing unit is used by electrophotographic image forming systems, such as copiers, laser printers, and others. The two-component developing unit uses a two-component developing method which is effective and useful to provide a high speed image forming capability for such an image forming apparatus.

In the two-component developing method, a non-magnetic sleeve containing a magnet therein is used as a developing agent support. A developing agent, including powdered toner and carriers, is carried by the surface of the non-magnetic sleeve. A magnetic brush is formed on the surface of the non-magnetic sleeve, and the brush is placed adjacent to an image support of the image forming apparatus. The developing agent is retained and carried by the brush. On the surface of the image support, an electrostatic latent image is formed. An electric field between the image support and the sleeve is produced by supplying a developing bias voltage to the sleeve. The toner selectively adheres to the surface of the image support due to the electric field to form a toner image according to the latent image, and then the toner image is transferred to blank paper to form the copy.

For example, a laser printer of a certain type scans a laser beam across a positively charged rotating photoconductive drum. The photoconductive drum serves as an image support of the laser printer. The areas hit by the laser beam lose their charge, and the positive charge remains only where the copy is to be black. A negatively charged powdered toner adheres to the positively charged areas of the drum and is then transferred to blank paper to form the copy.

Generally, a unit-mass charge quantity Q/M ($\mu$c/g) of the toner within the developing unit varies in a certain range depending on the surface characteristics of the toner and carriers and on the variations of the mass. Also, the toner is electrically charged when it contacts the carriers, and the unit-mass charge quantity Q/M of the toner varies depending on a non-driven period of the developing agent and on a mixing time of the developing agent. When the Q/M is too large, the optical density of the toner image becomes improperly low because of a firm adhesion between the toner and the carriers in the developing unit. When the Q/M is too small, or when the toner is reversely charged, the toner excessively adheres to the surface of the image support so as to produce a background smudge in the copy.

In order to eliminate the above-mentioned problems on the image quality, an AC bias developing method has been proposed. In the AC bias developing method, an AC (alternating current) bias voltage is superimposed to a DC (direct current) component of a developing bias voltage and it is supplied to the non-magnetic sleeve. It is known that the AC bias developing method serves to increase the developing capability. Further, it is known that reduction of the resistance of the carriers in the developing agent serves to provide an improved image quality and dot uniformity of the copy. Hereinafter, the developing capability is defined to be a ratio of the quantity of toner adhering to the image support (or the photoconductive drum) to the quantity of toner carried by the developing agent support (or the non-magnetic sleeve).

However, if the developing agent including reduced-resistance carriers is used, the Q/M of the toner considerably varies depending on the non-driven period of the developing agent and on the mixing time of the developing agent. After the developing agent is held in a non-driven condition over an extended period, the Q/M of the toner becomes too small. If the developing bias voltage wherein the AC bias voltage is superimposed to the DC component, is supplied to the non-magnetic sleeve with the developing agent in such a condition, a background smudge in the copy is likely to be produced.

Therefore, in order to achieve a good image quality of the copy, it is necessary to control the unit-mass charge quantity of the toner in the developing agent such that the Q/M of the toner is maintained at a constant value. If the Q/M of the toner is maintained at a constant value, it is possible to prevent the occurrence of a background smudge in the copy so that a good image quality can be achieved.

Generally, it is difficult to suitably control the charge quantity of the toner in the developing unit. Japanese Laid-Open Patent Application No. 8-44177 discloses an image forming apparatus having a developing unit provided with an auxiliary electrode. In the developing unit of the above publication, an AC bias voltage is supplied to the auxiliary electrode, and the supply of the AC bias voltage provides a mixing function of the developing agent and a control of the charge quantity of the toner, so as to reliably provide a good image quality of the copy. However, in the developing unit of the above publication, the developing bias voltage is not controlled in accordance with the charge quantity of the toner. After the developing agent is held in a non-driven condition over an extended period, the developing agent is carried by the non-magnetic sleeve and adheres to the surface of the image support before the time a start-up of the developing agent or the toner is achieved. Hence, in the developing unit of the above publication, a background smudge in the copy is likely to be produced when the developing agent is in such a condition, even if the AC bias voltage is supplied to the auxiliary electrode of the developing unit. Hereinafter, the start-up of the developing agent is defined to be a condition of the developing agent in which the quantity of charge of the toner therein apparently reaches an equilibrium condition.

Further, Japanese Laid-Open Patent Application No. 5-333673 discloses an image forming apparatus having a fixing unit provided with a warm-up time measuring device. The fixing unit is provided adjacent to the image support and serves to supply heat and pressure to a sheet having a toner image transferred from the image support, so that the toner image from the image support is stably fixed to the sheet. The warm-up time measuring device measures a warm-up time of the fixing unit in the image forming apparatus. When the warm-up time of the fixing unit measured by the warm-up time measuring device is larger than a reference time, a developing bias voltage supplied to the sleeve of a developing unit is controlled in accordance with a total number of copies counted by a copy counter of the image forming apparatus. More specifically, when the measured warm-up time of the fixing unit is too small, it is supposed that the start-up of the developing agent is not achieved. In such a condition, the DC component of the developing bias voltage supplied to the sleeve is increased. Also, the DC component of the developing bias voltage is increased as the total number of copies counted by the copy counter is increased to a given number. On the other hand, when the measured warm-up time of the fixing unit is larger than the reference time, it is supposed that the start-up time of the developing agent is achieved. In such a condition, the developing bias voltage supplied to the sleeve is held at a normal level.

However, in the image forming apparatus of the above publication, after the developing agent is held in a non-driven condition over an extended period (for example, one month), the developing agent is carried by the sleeve and adheres to the surface of the image support before a start-up of the developing agent. Hence, in the developing unit of the above publication, a background smudge in an initial copy is likely to be produced when the developing agent is in such a condition. Usually, the developing agent in the developing unit is mixed for a given time after the time a power switch of the image forming apparatus is turned ON in order to achieve the start-up of the developing agent. However, the developing agent, which has been held in a non-driven condition over an extended period, requires a mixing time longer than the given time because of a decrease of the Q/M of the toner.

A conceivable method for eliminating the background smudge with respect to the image forming apparatus of the above publication is that the developing agent, which has been held in a non-driven condition over an extended period, is mixed for a longer time after the power switch is turned ON. However, if the mixing time becomes long, the operator of the image forming apparatus must wait for the start-up of the developing agent over a long period. Hence, the operability of the image forming apparatus when the above-mentioned method is used is considerably lowered. It is difficult for the image forming apparatus of the above publication to provide both a good image quality and a speedy image formation when the developing agent is held in a non-driven condition over an extended period.

SUMMARY OF THE INVENTION

An object of the present invention is to provide an improved image forming apparatus in which the above-described problems are eliminated.

Another object of the present invention is to provide an image forming apparatus which provides not only a speedy image formation but also a good image quality at an initial time of image formation after the developing agent was held in a non-driven condition over an extended period.

The above-mentioned objects of the present invention are achieved by an image forming apparatus comprising: an image support which supports an electrostatic latent image on a surface of the image support; a developing unit which has a developing agent support, the developing agent support retaining a developing agent, including a toner and carriers, contained in the developing unit, and the developing unit converting the latent image on the image support into a toner image by causing the toner to adhere to the surface of the image support; a developing bias supplying unit which supplies a developing bias voltage to the developing agent support of the developing unit, the developing bias voltage being one of a DC bias voltage and an AC bias voltage; a timer which measures a non-driven period of the developing agent in the developing unit; and a control unit which selects one of the DC bias voltage and the AC bias voltage from the developing bias supplying unit based on the non-driven period measured by the timer, and controls the developing bias voltage at an output of the developing bias supplying unit such that the selected one of the DC bias voltage and the AC bias voltage is supplied to the developing agent support.

The above-mentioned objects of the present invention are achieved by an image forming apparatus comprising: an image support which supports an electrostatic latent image on a surface of the image support; a developing unit which has a developing agent support, the developing agent support retaining a developing agent, including a toner and carriers, contained in the developing unit, and the developing unit converting the latent image on the image support into a toner image by causing the toner to adhere to the surface of the image support; a developing bias supplying unit which supplies a variable AC bias voltage to the developing agent support of the developing unit; a timer which measures a non-driven period of the developing agent in the developing unit; and a control unit which controls the AC bias voltage at an output of the developing bias supplying unit based on the non-driven period measured by the timer, such that a peak-to-peak voltage of the AC bias voltage supplied to the developing agent support is decreased in proportion to the measured non-driven period.

In a preferred embodiment of the image forming apparatus of the present invention, the control unit selects one of the DC bias voltage and the AC bias voltage based on the non-driven period measured by the timer, and controls the developing bias voltage at the output of the developing bias supplying unit such that the selected one of the DC bias voltage and the AC bias voltage is supplied to the developing agent support. The image forming apparatus of the present invention is effective in preventing occurrence of a background smudge in the copy at an initial time of image formation after the developing agent was held in a non-driven condition over an extended period. Therefore, it is possible for the image forming apparatus of the present invention to provide not only a speedy image formation but also a good image quality at the initial time of image formation.

Further, in a preferred embodiment of the image forming apparatus of the present invention, the control unit controls the AC bias voltage at the output of the developing bias supplying unit based on the non-driven period measured by the timer, such that a peak-to-peak voltage of the AC bias voltage supplied to the developing agent support is decreased in proportion to the measured non-driven period. The image forming apparatus of the present invention is effective in preventing occurrence of a background smudge in the copy at an initial time of image formation after the developing agent was held in a non-driven condition over an extended period. Therefore, it is possible for the image forming apparatus of the present invention to provide not only a speedy image formation but also a good image quality at the initial time of image formation.

BRIEF DESCRIPTION OF THE DRAWINGS

Other objects, features and advantages of the present invention will become more apparent from the following detailed description when read in conjunction with the accompanying drawings in which.

DETAILED DESCRIPTION OF THE PREFERRED EMBODIMENTS

Before explaining the preferred embodiments of the image forming apparatus of the present invention, a description of the characteristics of a developing agent, used by the image forming apparatus of the present invention, will be given earlier.

Figure 1:
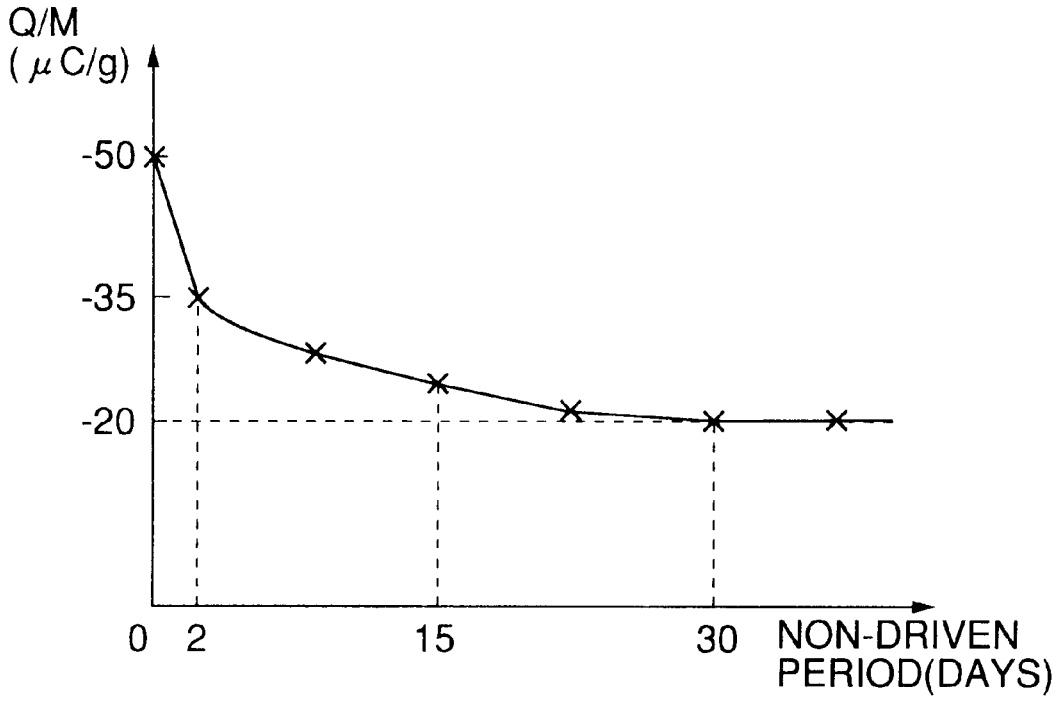
FIG. 1 is a diagram for explaining a relationship between the non-driven period of developing agent and the unit-mass charge quantity of toner.

FIG. 1 is a diagram for explaining a relationship between the non-driven period of a developing agent and the unit-mass charge quantity Q/M of a toner.

In FIG. 1, the non-drive period, plotted along the lateral axis, indicates a period (or the number of days) in which the developing agent is continuously held in a non-driven condition following the time the latest start-up of the developing agent was achieved. The unit-mass charge quantity Q/M, plotted along the vertical axis, indicates a quantity of negative charge per mass ($\mu$c/g) of the toner obtained through a blow-off measurement method which will be described later.

In the relationship of the developing agent, as shown in FIG. 1, the Q/M is rapidly lowered in two days following the time the latest start-up of the developing agent was achieved. Thereafter, the Q/M is gradually lowered up to 30 days following the time of the latest start-up of the developing agent, and it is nearly unchanged in the subsequent days.

Figure 2:
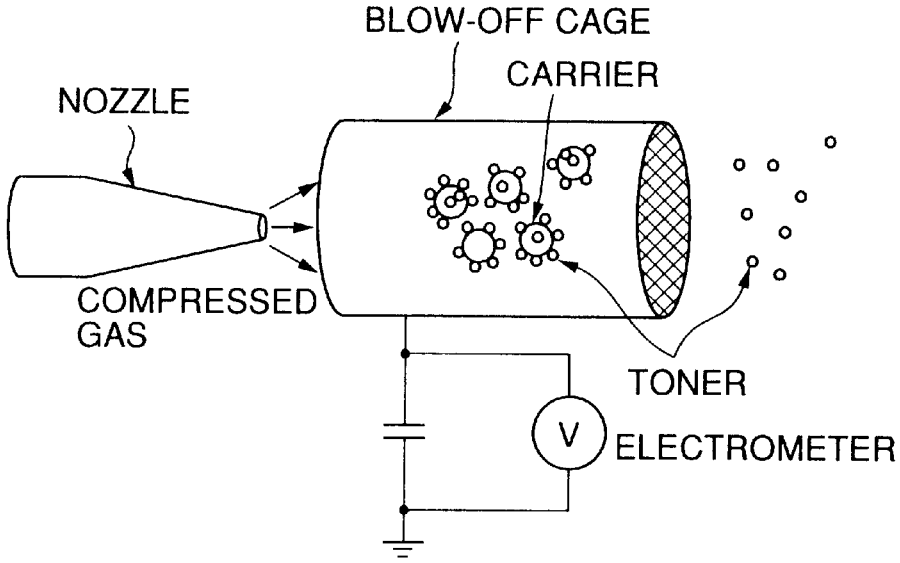
FIG. 2 is a diagram for explaining a method of measurement of the unit-mass charge quantity of toner.

FIG. 2 is a diagram for explaining a method of measurement of the unit-mass charge quantity of a toner. In FIG. 2, a blow-off measurement method which is used to measure the unit-mass charge quantity Q/M of the toner is illustrated.

As shown in FIG. 2, a two-component developing agent, including powdered toner and carriers, is entered into a blow-off cage of a conductive material. A wire net is attached to both ends of the blow-off cage. The wire net has a number of meshes each with a selected dimension, and the toner passes through the net but the carriers do not pass through it. Compressed gas from a nozzle is sprayed to the blow-off cage as shown in FIG. 2. The developing agent in the blow-off cage is separated into the toner outside the cage and the carriers remaining inside the cage. The carriers inside the cage have positive charge whose quantity is equivalent to a quantity of negative charge of the toner blown off from the cage. Therefore, the charge quantity of the toner results in by measuring the charge quantity of the carriers in the cage using an electrometer. The electrometer is connected at one end to the blow-off cage and grounded at the other end. The unit-mass charge quantity Q/M of the toner is calculated by dividing the resulting charge quantity by the mass of the toner blown off from the cage.

Figure 3:
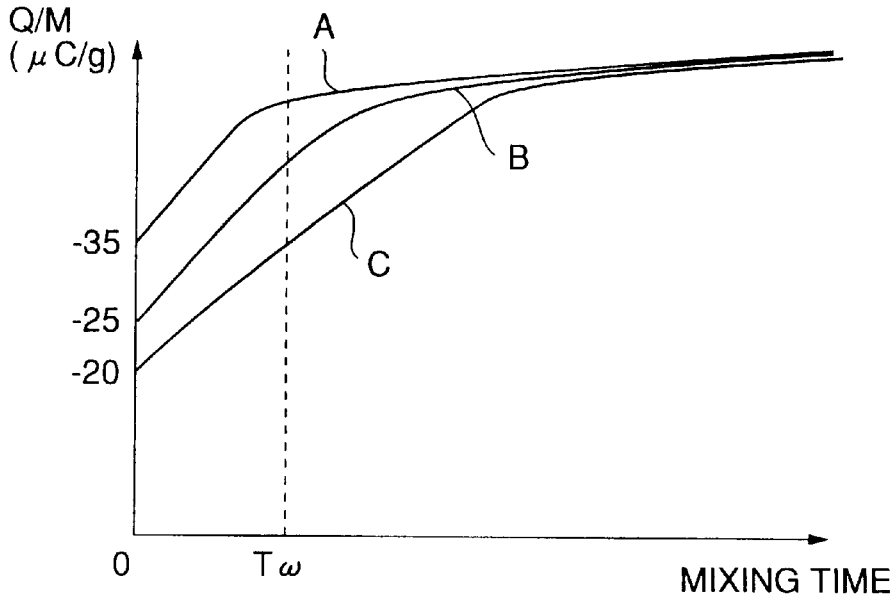
FIG. 3 is a diagram for explaining a relationship between the mixing time of developing agent and the unit-mass charge quantity of toner.

FIG. 3 is a diagram for explaining a relationship between the mixing time of the developing agent and the unit-mass charge quantity of the toner.

In FIG. 3, the mixing time, plotted along the lateral axis, indicates a period in which the developing agent is continuously mixed. The unit-mass charge quantity Q/M, plotted along the vertical axis, indicates a quantity of negative charge per mass ($\mu$c/g) of the toner measured by the blow-off measurement method of FIG. 2.

The graph, indicated by "A" in FIG. 3, represents the relationship between the mixing time and the unit-mass charge quantity Q/M after the developing agent has been held in the non-driven condition for two days. The graph, indicated by "B" in FIG. 3, represents the relationship between the mixing time and the unit-mass charge quantity Q/M after the developing agent has been held in the non-driven condition for fifteen days. The graph, indicated by "C" in FIG. 3, represents the relationship between the mixing time and the unit-mass charge quantity Q/M after the developing agent has been held in the non-driven condition for thirty days.

As shown in FIG. 3, in each case of the three graphs, the Q/M is rapidly raised until the mixing time exceeds a certain alteration point. Thereafter, the Q/M is gradually raised in the subsequent period. Hereinafter, a condition of the developing agent in which the mixing time exceeds the alteration point and the Q/M is gradually raised will be called an apparent start-up condition.

When a power switch of an image forming apparatus is turned ON, a developing unit of the image forming apparatus is initially warmed up for a certain period in order to mix the developing agent included in the developing unit. Suppose that this period corresponds to a warm-up period "Tw" indicated on the lateral axis in FIG. 3. In the case of the graph "A" (the developing agent has been held in the non-driven condition for two days), the Q/M is gradually raised at the warm-up period "Tw" and the developing agent already reaches the apparent start-up condition. However, in the cases of the graphs "B" and "C" (the developing agent has been held in the non-driven condition for fifteen or thirty days), the Q/M is rapidly raised at the warm-up period "Tw" and the developing agent still does not reach the apparent start-up condition.

Figure 4:
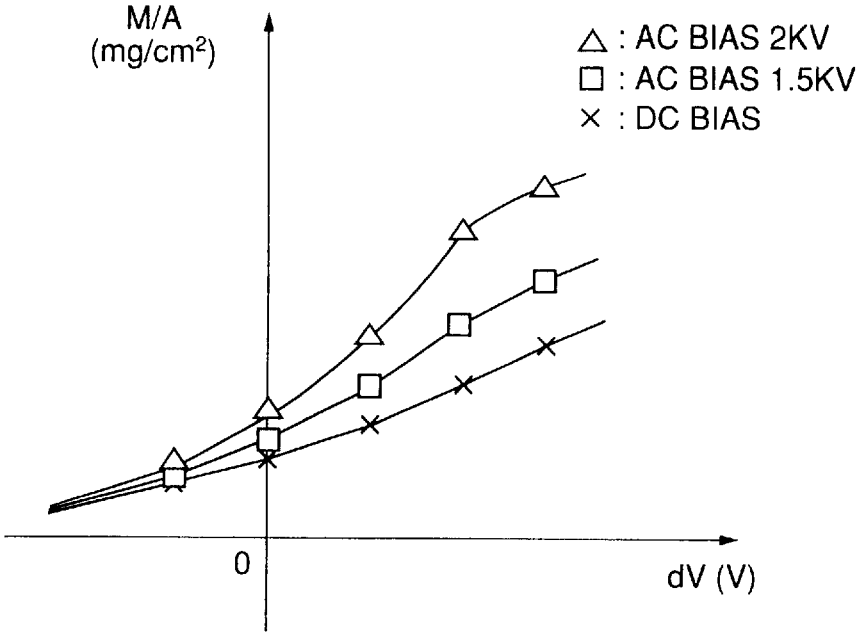
FIG. 4 is a diagram for explaining a relationship between the developing bias voltage and the developing capability.

FIG. 4 is a diagram for explaining a relationship between the developing bias voltage and the developing capability.

In FIG. 4, the developing bias voltage, plotted along the lateral axis, indicates a developing potential "dV" at which the toner from the developing unit is made to adhere to the surface of an image support (for example, a photoconductive drum) in the image forming apparatus. The developing capability M/A, plotted along the vertical axis, indicates a weight of the adherence toner per unit area ($mg/cm^2$) of the image support, which has been measured through an experiment performed by the inventors of the present invention. The measurement of the developing capability M/A is performed in three different cases. In the first case, a simple DC bias voltage is supplied to the developing unit as the developing bias voltage. In the second case, an AC bias voltage superimposed to a DC component of the developing bias voltage is supplied to the developing unit, and the amplitude of the AC bias voltage is set at 2 kV. In the third case, an AC bias voltage superimposed to the DC component of the developing bias voltage is supplied to the developing unit, and the amplitude of the AC bias voltage is set at 1.5 kV.

As shown in FIG. 4, the unit-area adherence toner weight M/A in the AC bias cases is larger than the M/A in the DC bias case, and the M/A in the AC bias cases is increased as the amplitude of the AC bias voltage is raised. That is, it can be understood that the developing capability of the developing unit is higher in the AC bias cases than in the DC bias case, and that the developing capability in the AC bias cases is further increased by raising the amplitude of the AC bias voltage.

If the AC bias voltage is supplied to the developing unit when the Q/M of the toner is low, the toner excessively adheres to the surface of the image support because of a high developing capability of the developing unit, thereby producing a background smudge or the like in the copy. Hence, when the Q/M of the toner is low, it is not necessary to supply the AC bias voltage to the developing unit. If the DC bias voltage is supplied to the developing unit when the Q/M of the toner is low, the developing capability of the developing unit is held at a low level suitable to make the toner properly adhere to the surface of the image support, thereby preventing the occurrence of a background smudge in the copy or the like. By carrying out such a control of the developing bias voltage, it is possible to achieve a good image quality of the copy after the developing agent was held in the non-driven condition over an extended period.

Briefly speaking, in the image forming apparatus of the present invention, a drive time counter is connected to a developing roller of the developing unit and a timer is connected to a main power supply of the image forming apparatus, in order to monitor a non-driven period of the developing agent within the developing unit. When the detected non-driven period of the developing agent is longer than a given reference time, the developing bias voltage is set at the DC bias voltage since the Q/M of the toner is still low. Hence, the developing capability of the developing unit is held at a low level suitable to make the toner properly adhere to the surface of the image support, thereby preventing the occurrence of a background smudge in the copy or the like. By carrying out such a control of the developing bias voltage, it is possible to achieve a good image quality of the copy at an initial time of image formation after the developing agent was held in a non-driven condition over an extended period.

A description will now be given of the preferred embodiments of the image forming apparatus of the present invention with reference to the accompanying drawings of FIG. 5 through FIG. 17.

Figure 5:
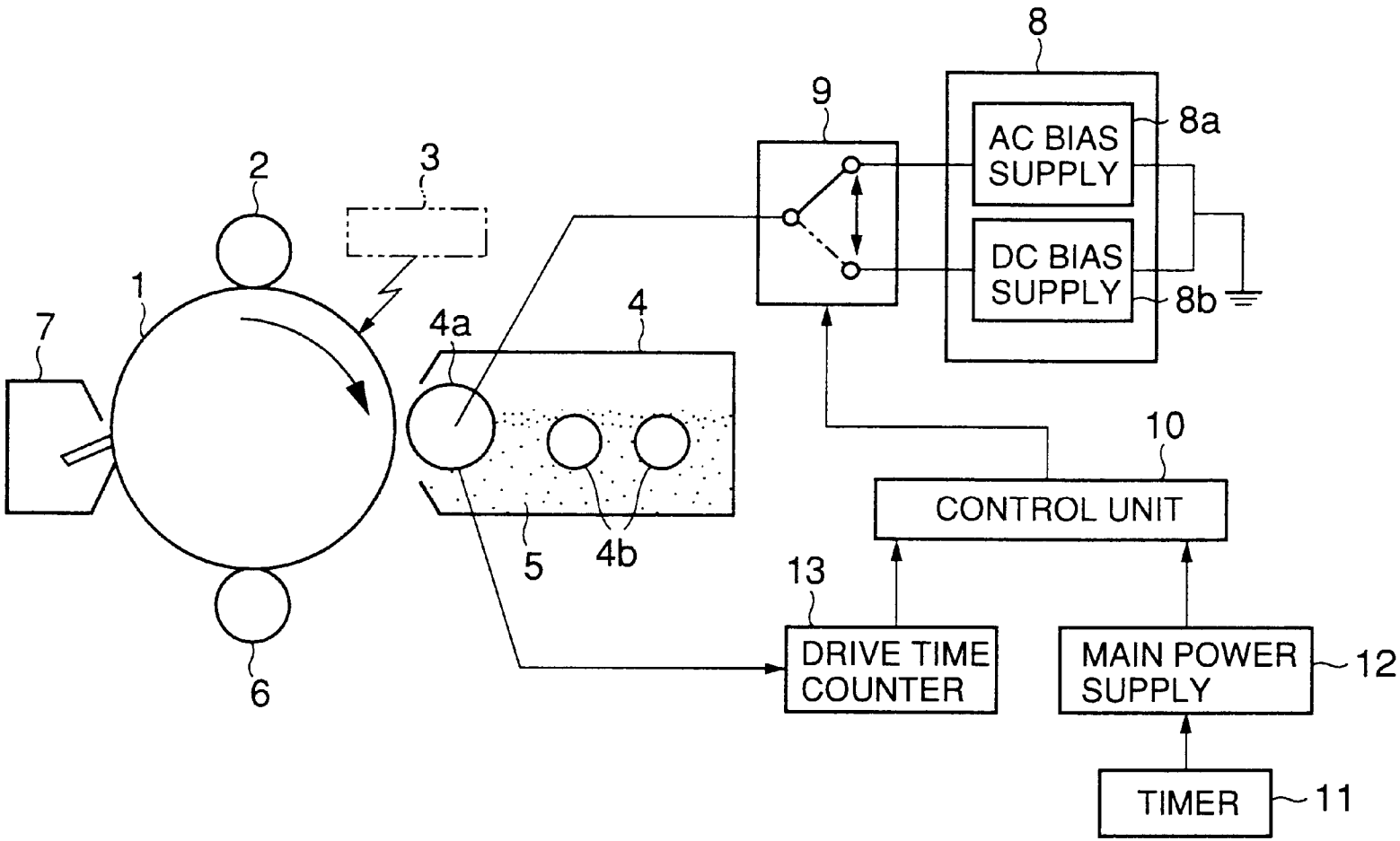
FIG. 5 is a block diagram showing an essential part of one embodiment of the image forming apparatus of the present invention.

FIG. 5 shows an essential part of one embodiment of the image forming apparatus of the present invention.

As shown in FIG. 5, in the present embodiment of the image forming apparatus, a rotary photoconductive drum 1 of an organic photoconductive material is provided. The photoconductive drum 1 serves as the image support in the image forming apparatus. The photoconductive drum 1 is rotated in a direction indicated by the arrow in FIG. 5. On the periphery of the photoconductive drum 1, a charger 2 is provided. The charger 2 positively charges the surface of the photoconductive drum 1 such that the positive charge is uniformly distributed on the surface of the photoconductive drum 1. A laser scan unit 3 is provided adjacent to the surface of the photoconductive drum 1, and the laser scan unit 3 scans a laser beam across the positively charged surface of the rotating photoconductive drum 1 so that an electrostatic latent image is formed thereon.

Further, in the image forming apparatus of FIG. 5, a developing unit 4 is provided around the periphery of the photoconductive drum 1. An electric field between the photoconductive drum 1 and the developing unit 4 is produced by supplying a developing bias voltage to the developing unit 4. The toner from the developing unit 4 adheres to the surface of the photoconductive drum 1 due to an electrostatic attracting force caused by the electric field, so as to form a toner image according to the latent image on the photoconductive drum 1. Hence, the developing unit 4 converts the latent image on the photoconductive drum 1 into a toner image by causing the toner to adhere to the surface of the photoconductive drum 1. A transfer unit 6 is provided around the periphery of the photoconductive drum 1 as shown in FIG. 5. The transfer unit 6 transfers the toner image from the photoconductive drum 1 to blank paper or a sheet of recording material to form the copy. A cleaning unit 7 is provided around the periphery of the photoconductive drum 1 as shown in FIG. 5. The cleaning unit 7 removes the toner remaining on the surface of the photoconductive drum 1 after the transfer of the toner image.

Further, in the image forming apparatus of FIG. 5, a developing bias supplying unit 8, a developing bias switching unit 9, a control unit 10, a timer 11, a main power supply 12, and a drive time counter 13 are provided. These elements of the image forming apparatus in the present embodiment will be described later.

The developing unit 4 is provided with a developing roller 4*a* and mixing screws 4*b*. A developing agent 5, including powdered toner and carriers, is contained in the developing unit 4. The developing roller 4*a* contains a magnet (not shown) therein. The developing roller 4*a* is driven in accordance with the rotation of the photoconductive drum 1. A magnetic brush (not shown) is formed on the surface of the roller 4*a*, and the developing unit 4 is arranged such that the brush is placed adjacent to the surface of the photoconductive drum 1. The developing agent 5 is retained and carried by the brush of the developing roller 4*a*. Hence, the developing roller 4*a* serves as the developing agent support which retains and carries the developing agent 5. The mixing screws 4*b* are rotated in synchronism with the driving of the developing roller 4*a*, in order to mix the developing agent 5 within the developing unit 4.

In the present embodiment, the developing agent 5, contained in the developing unit 4, includes a black toner having particles whose size is about 7.5 $\mu$m, and low-resistance carriers having particles whose size is about 50 $\mu$m. The resistance of the carriers of the developing agent 5 is measured under the following experimental condition. That is, the above-mentioned developing agent 5 is contained in a practical model of the developing unit 4 of the present embodiment, and the developing unit 4 is attached to an aluminum drum instead of the photoconductive drum 1. An electric field between the aluminum drum and the developing unit 4 is produced by supplying a DC voltage to the developing unit 4, and a quantity of electric current flowing between the aluminum drum and the developing unit 4 is measured. The resistance of the carriers of the developing unit 4 is calculated from the supplied voltage and the measured current. As a result of the above measurement, when the DC voltage supplied is at 1000 V, the resistance of the carriers of the developing agent 5 is in the range of $10^9$ Ω to $10^{10}$ Ω. The above measurement is performed under the condition in which the rotation of the developing unit 4 is stopped.

Referring back to FIG. 5, the developing bias supplying unit 8 is provided with both an AC bias supply 8*a* and a DC bias supply 8*b*. The developing bias supplying unit 8 is connected through the developing bias switching unit 9 to the developing roller 4*a*. The developing bias supplying unit 8 supplies both an AC bias voltage generated by the AC bias supply 8*a* and a DC bias voltage generated by the DC bias supply 8*b* to the developing bias switching unit 9. A switching action of the developing bias switching unit 9 is controlled by the control unit 10 such that a selected one of the AC bias voltage and the DC bias voltage from the developing bias supplying unit 8 is supplied to the developing roller 4*a* in accordance with the switching action of the developing bias switching unit 9.

In the present embodiment, the DC bias voltage (Vdc) supplied by the developing bias supplying unit 8 is set at −600 V. The AC bias voltage (Vac) supplied by the developing bias supplying unit 8 is set as follows: the AC bias voltage (Vac) having an asymmetrical rectangular waveform; the peak-to-peak voltage (Vpp) being set at 2 kV; the frequency (f) being set at 5 kHz; the duty ratio being set at 20%; and the integral average voltage (Va) being set at −600 V.

Figure 6:
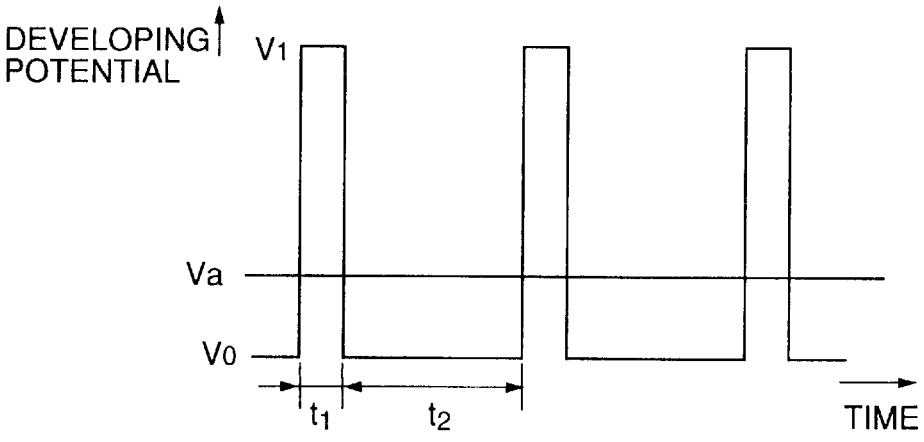
FIG. 6 is a waveform diagram for explaining a waveform of an AC bias voltage generated by the image forming apparatus shown in FIG. 5.

FIG. 6 is a waveform diagram for explaining a waveform of an AC bias voltage generated by the image forming apparatus shown in FIG. 5.

In FIG. 6, the lateral axis indicates an elapsed time, and the vertical axis indicates a developing potential of the AC bias voltage. The upward direction of the vertical axis is arranged such that it corresponds to a negative potential of the AC bias voltage at which the toner from the developing unit 4 is attracted to adhere to the surface of the photoconductive drum 1.

As shown in FIG. 4, "V1" denotes an upper-peak potential of the AC bias voltage when the force to draw the toner to the photoconductive drum 1 is the maximum, "V0" denotes a lower-peak potential of the AC bias voltage when the force to draw the toner to the developing roller 4*a* is the maximum, "t1" denotes a duration of the upper-peak potential V1 within one cycle of the waveform, and "t2" denotes a duration of the lower-peak potential V0 within one cycle of the waveform.

The waveform of the AC bias voltage (Vac) shown in FIG. 6 is defined by the following parameters:

the peak-to-peak voltage $Vpp=|V1-V0|$, the frequency $f=1/(t1+t2)$, the duty ratio $=t1/(t1+t2)\times 100$ (%), the integral average voltage $$Va=V0+(V1-V0)\times t1/(t1+t2).$$

In the present embodiment, the integral average voltage Va of the AC bias voltage Vac is set such that it is equal to the DC bias voltage VDC.

Referring back to FIG. 5, in the present embodiment of the image forming apparatus, the main power supply 12 is connected to the control unit 10. The drive time counter 13 is connected to the developing roller 4*a* of the developing unit 4. The drive time counter 13 counts a drive time of the developing roller 4*a*, and outputs the counted drive time to the control unit 10. The timer 11 is connected through the main power supply 12 to the control unit 10. The timer 11 is turned ON to start counting a non-driven period of the developing agent 5 immediately after the main power supply 12 is OFF, and turned OFF to stop counting the non-driven period of the developing agent 5 immediately after the main power supply 12 is ON. The timer 11 outputs the measured non-driven period to the control unit 10.

In the image forming apparatus of FIG. 5, the control unit 10 controls the switching action of the developing bias switching unit 9 based on both the drive time output by the drive time counter 13 and the non-driven period output by the timer 11. Hence, the image forming apparatus supplies a selected one of the AC bias voltage and the DC bias voltage to the developing roller 4*a* in accordance with the switching action controlled by the control unit 10.

In the present embodiment, when the non-driven period (t) output by the timer 11 is longer than a given reference time (To), the developing bias voltage to be supplied to the developing roller 4*a* is set at the DC bias voltage. On the other hand, when the non-driven period (t) output by the timer 11 is not longer than the reference time (To), the developing bias voltage to be supplied to the developing roller 4*a* is set at the AC bias voltage. The above-mentioned reference time (To) in the present embodiment is preset to 15 days.

Further, when the DC bias voltage is continuously supplied to the developing roller 4*a* of the developing unit 4, the mixing screws 4*b* are rotated in synchronism with the driving of the developing roller 4*a* in order to mix the developing agent 5 within the developing unit 4. The Q/M of the toner is raised in proportion to the mixing time of the developing agent 5. A duration in which the DC bias voltage is continuously supplied to the developing roller 4*a* is detected by the control unit 10 based on the drive time output by the drive time counter 13. In order to achieve a good image quality of the copy despite the rising Q/M of the toner, in the present embodiment, when the duration in which the DC bias voltage is continuously supplied to the developing roller 4*a* exceeds a given reference drive time (No), the developing bias voltage to be supplied to the developing roller 4*a* is switched to the AC bias voltage. Further, in the present embodiment, the switching of the developing bias voltage from the DC bias voltage to the AC bias voltage is performed at the beginning of a next cycle of image formation in order to avoid the switching during a current cycle of image formation. The above-mentioned reference drive time (No) in the present embodiment is preset to 30 seconds.

The values of the reference time (To) and the reference drive time (No) depend on the kind of the developing agent used by the image forming apparatus. It is necessary that a reference time and a reference drive time, appropriate for the developing agent used, be predetermined by performing a preliminary measurement. When the main power supply 12 is turned OFF during the supply of the DC bias voltage, the timer 11 starts counting a non-driven period of the developing agent from the reference time (To).

As described above, the reference time (To) in the present embodiment is preset to 15 days. As shown in FIG. 1, the Q/M of the toner is rapidly lowered in 2 days after the time of the latest start-up of the developing agent, and then the Q/M is gradually lowered up to 30 days after. Taking account of the influence of environmental conditions (for example, humidity) and the characteristics of the Q/M of the toner, the inventors have determined that presetting the reference time (To) to 15 days, which lies approximately in the middle of the 2-day period and the 30-day period, is most appropriate to achieve a good image quality for various kinds of the developing agent.

As described above, the reference drive time (No) in the present embodiment is preset to 30 seconds. In the image forming apparatus of the present embodiment, when the main power supply 12 is turned ON, the mixing screws 4*b* are initially rotated during the warm-up period Tw in order to mix the developing agent 5 within the developing unit 4. Hence, the Q/M of the toner at this time is raised in proportion to the mixing time of the developing agent 5, regardless of the length of the non-driven period of the developing agent 5, as shown in FIG. 3. Taking account of the influence of the mixing of the developing agent both for the warm-up period Tw and for the duration in which the DC bias voltage is continuously supplied to the developing roller 4*a*, the inventors have determined that presetting the reference drive time (No) to 30 seconds is most appropriate to achieve a good image quality by using the image forming apparatus of the present embodiment.

Figure 7:
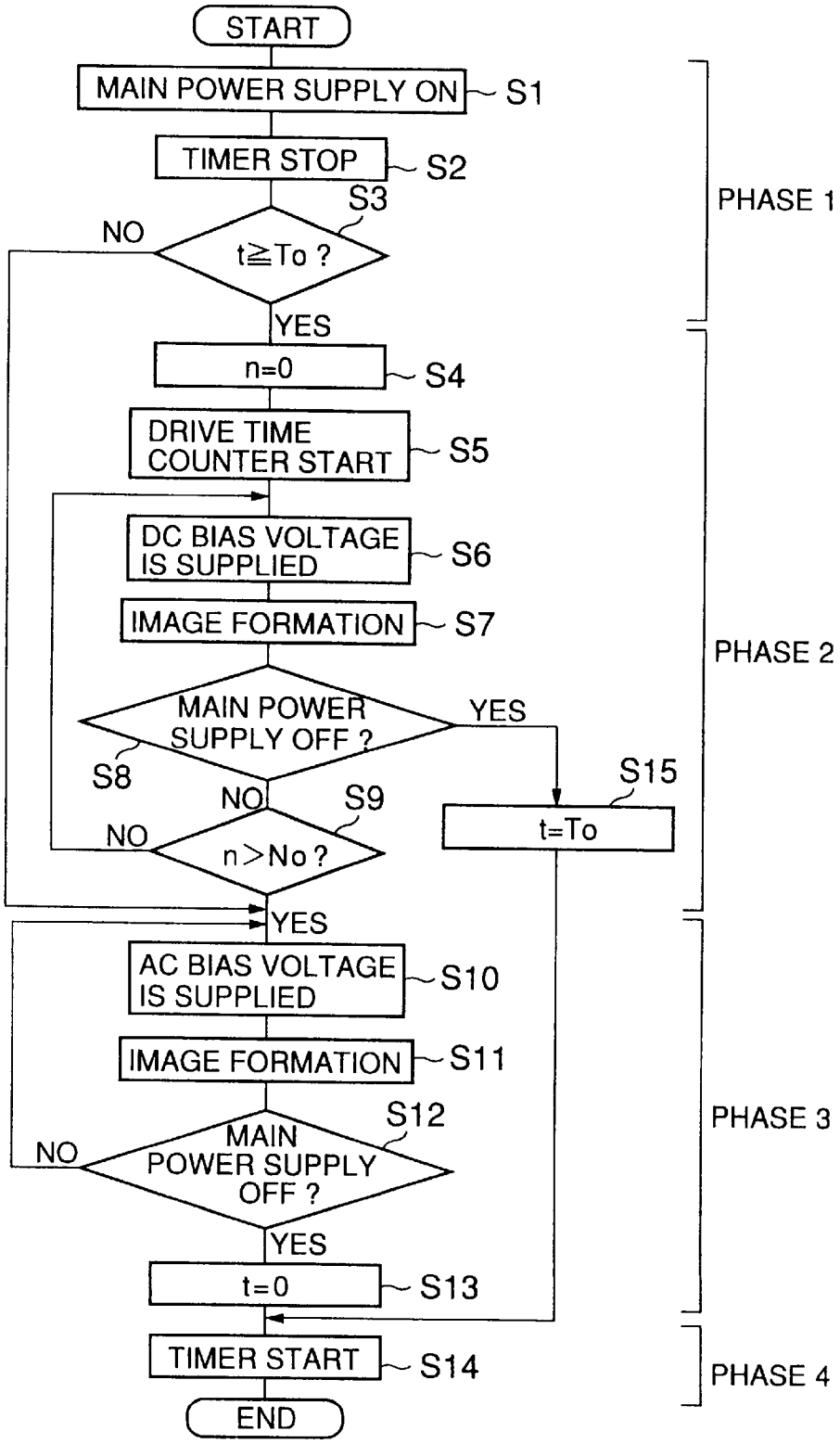
FIG. 7 is a flowchart for explaining a developing bias control process performed by a control unit of the image forming apparatus shown in FIG. 5.

FIG. 7 is a flowchart for explaining a developing bias control process performed by the control unit of the image forming apparatus shown in FIG. 5.

As shown in FIG. 7, the developing bias control process, performed by the control unit 10 in the present embodiment, is constituted by four phases: "Phase 1", "Phase 2", "Phase 3", and "Phase 4".

At the start of the developing bias control process of FIG. 7, the control unit 10 at step S1 detects that the main power supply 12 is ON. After the step S1 is performed, the control unit 10 at step S2 turns OFF the timer 11 to stop counting the non-driven period of the developing agent 5. The control unit 10 at this time reads the non-driven period "t" measured by the timer 11. After the step S2 is performed, the control unit 10 at step S3 makes a determination as to whether the measured non-driven period "t" exceeds the reference time "To". When the result at the step S3 is affirmative (t≧To), the control unit 10 proceeds to the "Phase 2". When the result at the step S3 is negative (t<To), the control unit 10 proceeds to the "Phase 3".

The above-described steps S1 through S3 are included in the "Phase 1" of the developing bias control process shown in FIG. 7.

When t≧To, the control unit 10 at step S4 resets the drive time counter 13 so that the drive time "n" is initialized to 0 (n=0). After the step S4 is performed, the control unit 10 at step S5 turns ON the drive time counter 13 to start counting the drive time "n" of the developing roller 4*a*. After the step S5 is performed, the control unit at step S6 controls the switching action of the developing bias switching unit 9 so that the DC bias voltage is supplied to the developing roller 4*a*. After the step S6 is performed, the control unit 10 at step S7 performs a current cycle of image formation. After the step S7 is performed, the control unit 10 at step S8 makes a determination as to whether the main power supply 12 is turned OFF during the supply of the DC bias voltage to the developing roller 4*a*.

When the result at the step S8 is affirmative (the main power supply 12 is OFF), the control unit 10 at step S15 sets the timer 11 at the reference time To (t=To). After the step S15 is performed, the control unit 10 proceeds to the "Phase 4".

When the result at the step S8 is negative (the main power supply 12 is ON), the control unit 10 at step S9 makes a determination as to whether the drive time "n" output by the drive time counter 13 exceeds the reference drive time "No". When the result at the step S9 is negative (n≦No), the control unit 10 repeats the above step S6. When the result at the step S9 is affirmative (n>No), the control unit 10 proceeds to the "Phase 3".

The above steps S4 through S9 and the above step S15 are included in the "Phase 2" of the developing bias control process shown in FIG. 7.

When t<To (the negative answer to the above step S3), or when n>No (the affirmative answer to the above step S9), the control unit 10 at step S10 controls the switching action of the developing bias switching unit 9 so that the AC bias voltage is supplied to the developing roller 4*a*. After the step S10 is performed, the control unit 10 at step S11 performs a following cycle of image formation. After the step S11 is performed, the control unit 10 at step S12 makes a determination as to whether the main power supply 12 is turned OFF during the supply of the AC bias voltage to the developing roller 4*a*.

When the result at the step S12 is affirmative (the main power supply 12 is OFF), the control unit 10 at step S13 resets the timer 11 to zero (t=0). After the step S13 is performed, the control unit 10 proceeds to the "Phase 4". When the result at the step S12 is negative (the main power supply 12 is ON), the control unit 10 repeats the above step S10.

The above steps S10 through S13 are included in the "Phase 3" of the developing bias control process shown in FIG. 7.

After either the step S13 or the step S15 is performed, the control unit 10 at step S14 turns ON the timer 11 to start counting the non-driven period "t" of the developing agent 5. After the step S14 is performed, the developing bias control process of FIG. 7 ends.

Only the above step S14 is included in the "Phase 4" of the developing bias control process shown in FIG. 7.

Figure 8:
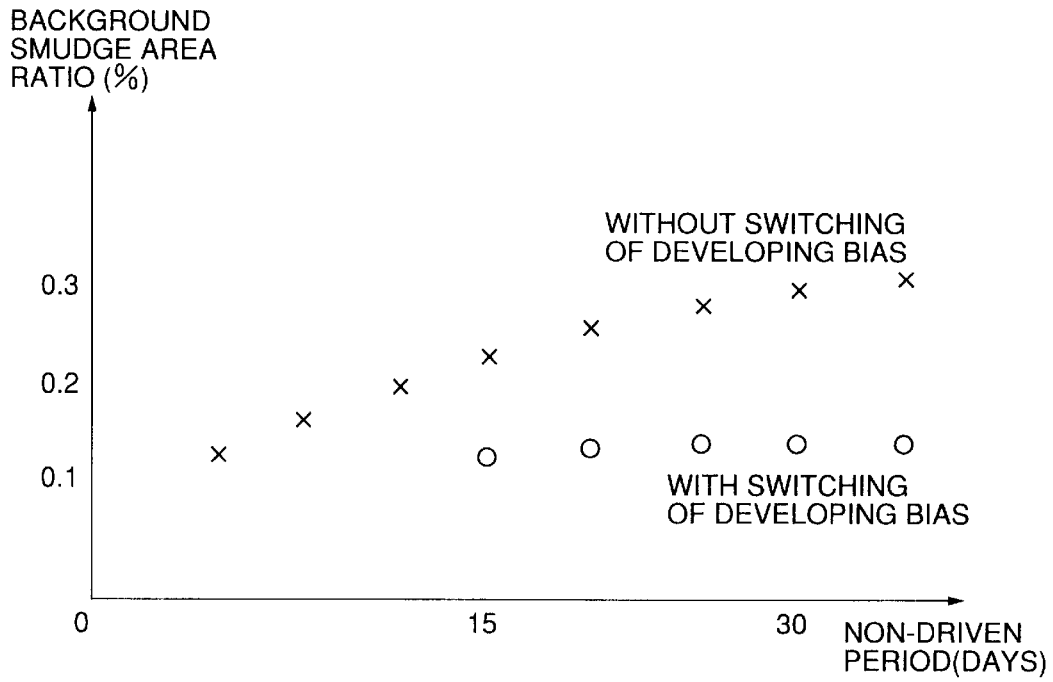
FIG. 8 is a diagram for explaining a relationship between the non-driven period and the background smudge area ratio when switching of the DC bias voltage to the AC bias voltage is performed.

FIG. 8 is a diagram for explaining a relationship between the non-driven period and the background smudge area ratio when the switching of the DC bias voltage to the AC bias voltage is performed.

In FIG. 8, the non-driven period, plotted along the lateral axis, indicates a period (or the number of days) in which the developing agent is continuously held in the non-driven condition following the time the latest start-up of the developing agent was achieved. The background smudge area ratio, plotted along the vertical axis, indicates an estimated ratio (%) of the background smudge area to the entire image area in the copy. The background smudge area ratio has been measured from sample copies through an experiment performed by the inventors.

Further, in FIG. 8, a relationship between the non-driven period and the background smudge area ratio when the switching of the DC bias voltage to the AC bias voltage is not performed, is illustrated for the purpose of comparison. Hereinafter, the relationship when the above-mentioned switching is not performed is called the "without switching" case, and the relationship when the above-mentioned switching is performed according to the present embodiment is called the "with switching" case.

As shown in FIG. 8, with respect to the developing agent which has been held in the non-driven condition for 15 or more days after the time of the latest start-up, the background smudge area ratio is remarkably lower in the "with switching" case than in the "without switching" case. Hence, the image forming apparatus of the present embodiment is effective in preventing occurrence of a background smudge in the copy at an initial time of image formation after the developing agent was held in a non-driven condition over an extended period. Therefore, it is possible for the image forming apparatus of the present embodiment to provide not only a speedy image formation but also a good image quality at the initial time of image formation.

Figure 9:
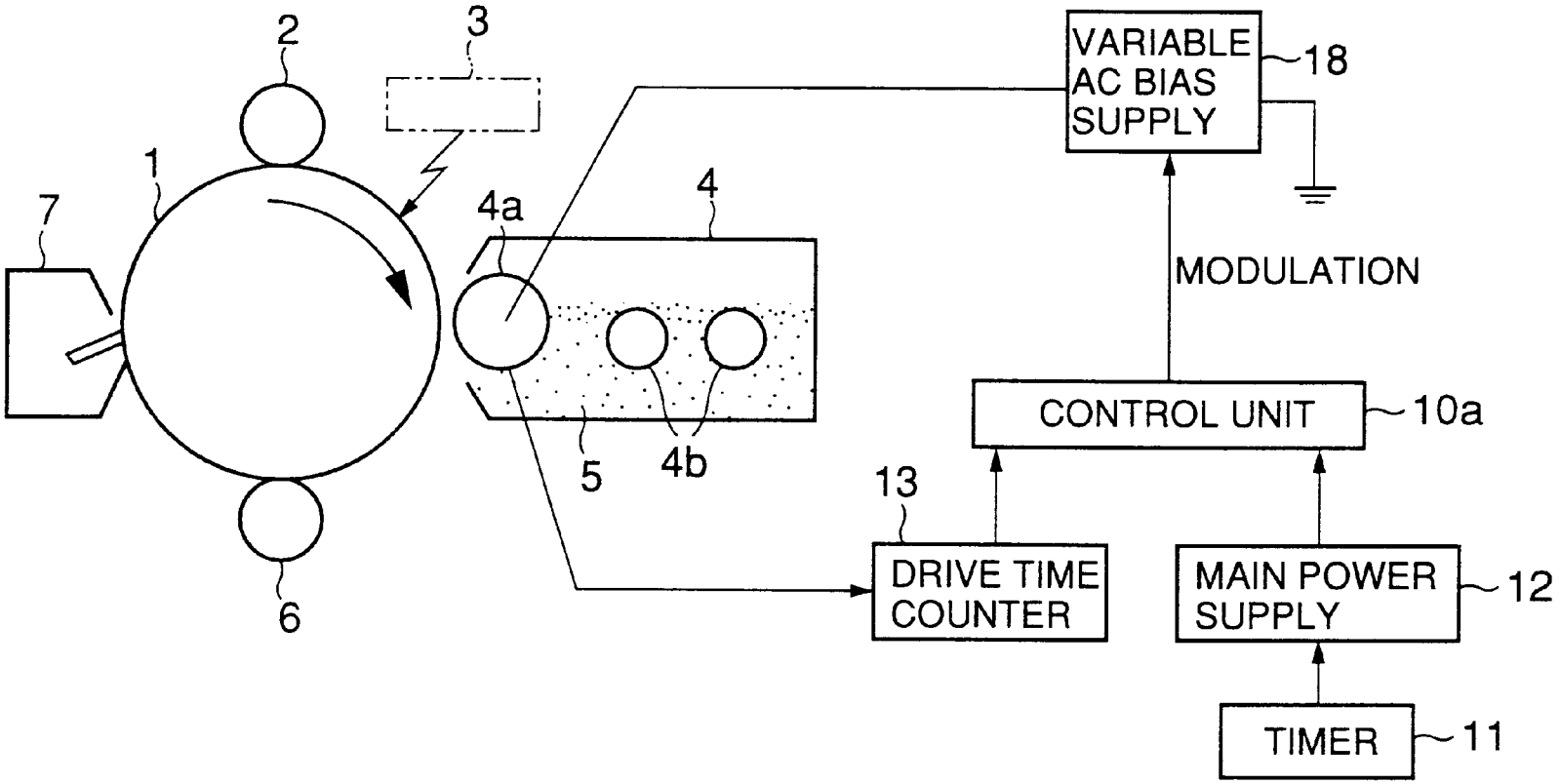
FIG. 9 is a block diagram showing an essential part of another embodiment of the image forming apparatus of the present invention.

Next, FIG. 9 shows an essential part of another embodiment of the image forming apparatus of the present invention.

In FIG. 9, the elements which are the same as corresponding elements in FIG. 5 are designated by the same reference numerals, and a description thereof will be omitted.

As shown in FIG. 9, in the present embodiment, a developing bias supplying unit 18 is provided with a variable AC bias supply which supplies a variable AC bias voltage. The developing bias supplying unit 18 is connected directly to the developing roller 4*a*. The developing bias switching unit 9 as in the previous embodiment of FIG. 5 is not provided in the present embodiment. The AC bias voltage at the output of the developing bias supplying unit 18 is controlled by a control unit 10*a* based on the non-driven period measured by the timer 11, such that a peak-to-peak voltage Vpp of the AC bias voltage supplied to the developing roller 4*a* is modulated in a step-by-step manner in proportion to the measured non-driven period.

Alternatively, the developing bias supplying unit 18 may be provided with a variable AC bias supply and a DC bias supply. For example, when the peak-to-peak voltage Vpp of the AC bias voltage supplied to the developing roller 4*a* is set at zero, a DC bias voltage can be supplied to the developing roller 4*a* by such a developing bias supplying unit 18.

In the image forming apparatus of FIG. 9, the main power supply 12 is connected to the control unit 10*a*. The drive time counter 13 is connected to the developing roller 4*a* of the developing unit 4. The drive time counter 13 counts a drive time of the developing roller 4*a*, and outputs the counted drive time to the control unit 10*a*. The timer 11 is connected through the main power supply 12 to the control unit 10*a*. The timer 11 is turned ON to start counting a non-driven period of the developing agent 5 immediately after the main power supply 12 is OFF, and turned OFF to stop counting the non-driven period of the developing agent 5 immediately after the main power supply 12 is ON. The timer 11 outputs the measured non-driven period to the control unit 10*a*.

In the image forming apparatus of FIG. 9, the control unit 10*a* controls the AC bias voltage at the output of the developing bias supplying unit 18 based on the non-driven period "t" measured by the timer 11, such that a peak-to-peak voltage Vpp of the AC bias voltage supplied to the developing roller 4*a* is modulated in a step-by-step manner in proportion to the measured non-driven period "t". It is possible for the present embodiment of the image forming apparatus to more flexibly carry out the developing bias voltage control in accordance with the length of the non-driven period of the developing agent 5, which will be described later.

Figure 10:
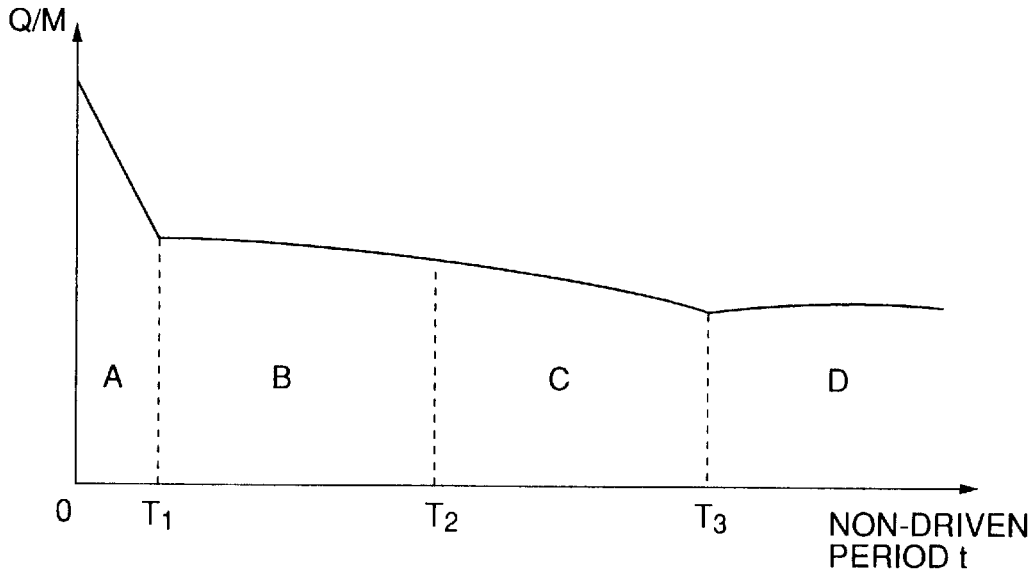
FIG. 10 is a diagram for explaining a relationship between the non-driven period and the unit-mass charge quantity.

FIG. 10 is a diagram for explaining a relationship between the non-driven period of the developing agent and the unit-mass charge quantity of the toner according to the present embodiment of the image forming apparatus.

As shown in FIG. 10, the relationship between the non-driven period "t" of the developing agent and the unit-mass charge quantity Q/M of the toner in the present embodiment is schematically represented by a line graph. The non-driven period "t" is divided at three reference times "T1", "T2" and "T3" (which are plotted along the lateral axis of FIG. 10) into four regions: "A", "B", "C" and "D". In FIG. 10, the reference time point "T2" lies on the lateral axis "t" in between the point "T1" and the point "T3". In the present embodiment, the reference time "T1" is preset to 2 days, the reference time "T2" is preset to 14 days, and the reference time "T3" is preset to 30 days.

AS shown in FIG. 10, the Q/M of the toner can be defined to be a linear function of the non-driven period "t" (which is measured by the timer 11). In the present embodiment, the developing bias voltage control is performed by modulating the peak-to-peak voltage Vpp of the AC bias voltage in a step-by-step manner in accordance with the length of the non-driven period "t" measured by the timer 11. That is, the AC bias voltage supplied to the developing roller 4*a* is varied by the control unit 10*a* into four developing bias voltages "$V_{BA}$", "$V_{BB}$", "$V_{BC}$" and "$V_{BD}$", depending on which of the regions A, B, C and D the measured non-driven period "t" pertains to. The correspondence between the non-driven period regions and the developing bias voltages according to the present embodiment is illustrated as follows.

TABLE 1

| REGION | DEVELOPING BIAS | Vpp (kV) |
|---|---|---|
| A: $0 < t \leqq T1$ | $V_{BA}$ (AC) | 2 |
| B: $T1 < t \leqq T2$ | $V_{BB}$ (AC) | 1.5 |
| C: $T2 < t \leqq T3$ | $V_{BC}$ (AC) | 1 |
| D: $T3 < t$ | $V_{BD}$ (DC) | 0 |

As indicated in the above TABLE 1, when the non-driven period "t" pertains to the region "A", the developing bias voltage "$V_{BA}$" is supplied to the developing roller 4*a*. When the non-driven period "t" pertains to the region "B", the developing bias voltage "$V_{BB}$" is supplied to the developing roller 4*a*. When the non-driven period "t" pertains to the region "C", the developing bias voltage "$V_{BC}$" is supplied to the developing roller 4*a*. When the non-driven period "t" pertains to the region "D", the developing bias voltage "$V_{BD}$" is supplied to the developing roller 4*a*. The developing bias voltages "$V_{BA}$", "$V_{BB}$" and "$V_{BC}$" are AC bias voltages with a predetermined peak-to-peak voltage Vpp (as in the above TABLE 1). In each of these AC bias voltages: the frequency (f) is set at 5 kHz; the duty ratio is set at 20%; and the integral average voltage (Va) is set at −600 V. The developing bias voltage "$V_{BD}$" is a DC bias voltage, the peak-to-peak voltage Vpp being set at zero. In the present embodiment, the developing bias voltage "$V_{BD}$" is set to −600 V.

Accordingly, in the present embodiment, the control unit 10*a* controls the AC bias voltage at the output of the developing bias supplying unit 18 based on the non-driven period "t" measured by the timer 11, such that a peak-to-peak voltage Vpp of the AC bias voltage, supplied to the developing roller 4*a*, is modulated in a step-by-step manner in proportion to the measured non-driven period "t". It is possible for the present embodiment of the image forming apparatus to more flexibly carry out the developing bias voltage control in accordance with the length of the non-driven period of the developing agent 5. The image forming apparatus of the present embodiment is effective in preventing occurrence of a background smudge in the copy at an initial time of image formation after the developing agent was held in a non-driven condition over an extended period. It is possible for the image forming apparatus of the present embodiment to provide not only a speedy image formation but also a good image quality at the initial time of image formation.

Similar to the previous embodiment of FIG. 5, when the AC bias voltage is continuously supplied to the developing roller 4*a* of the developing unit 4, the mixing screws 4*b* are rotated in synchronism with the driving of the developing roller 4*a* in order to mix the developing agent 5 within the developing unit 4. The Q/M of the toner is raised in proportion to the mixing time of the developing agent 5. A duration in which the AC bias voltage is continuously supplied to the developing roller 4*a* is detected by the control unit 10*a* based on the drive time output by the drive time counter 13. In order to achieve a good image quality of the copy despite the rising Q/M of the toner, in the present embodiment, when the duration in which the AC bias voltage is continuously supplied to the developing roller 4*a* exceeds a reference mixing time, the peak-to-peak voltage Vpp of the AC bias voltage at the output of the developing bias supplying unit 18 is increased so as to suit the rising Q/M of the toner, by switching one of the developing bias voltages ("$V_{BA}$", "$V_{BB}$", "$V_{BC}$" and "$V_{BD}$") to the next one. For example, if the non-drive period of the developing agent is in the region D of FIG. 10, the developing bias voltage is switched from "$V_{BD}$" to one of "$V_{BC}$", "$V_{BB}$" and "$V_{BA}$" sequentially, in this order, every time the duration of the supply of the developing bias voltage (which duration is equivalent to the drive time "n" counted by the drive time counter 13) exceeds a given reference time. In the present embodiment, each reference mixing time for the regions A through D of FIG. 10 is determined by the control unit 10*a* based on the non-driven period "t" measured by the timer 11.

Further, in the present embodiment, the switching of the developing bias voltage is performed at the beginning of a next cycle of image formation in order to avoid the switching during a current cycle of image formation.

Figure 11:
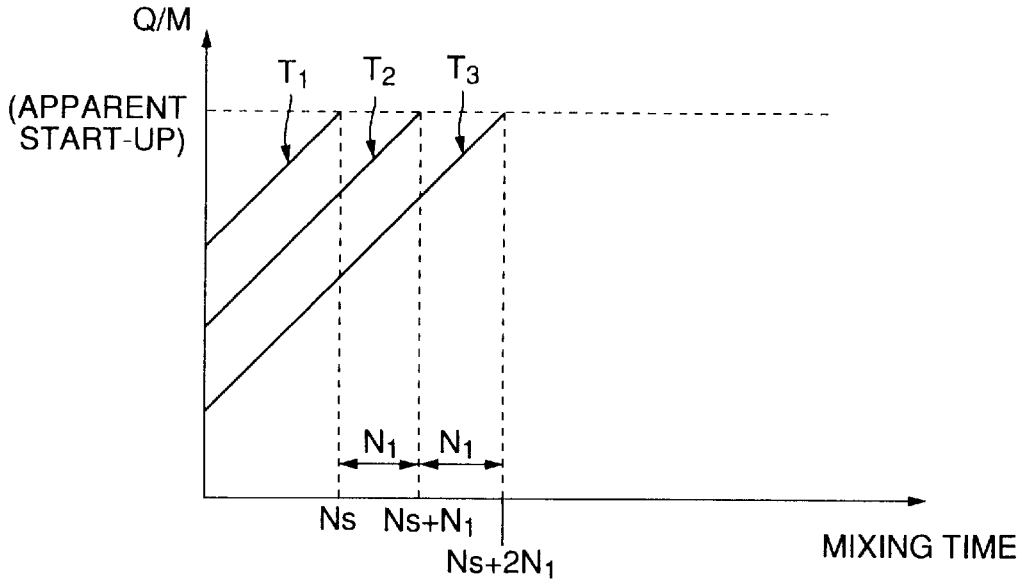
FIG. 11 is a diagram for explaining a relationship between the mixing time and the unit-mass charge quantity.

FIG. 11 is a diagram for explaining a relationship between the mixing time and the unit-mass charge quantity according to the present embodiment of the image forming apparatus.

As shown in FIG. 11, the relationship between the mixing time of the developing agent and the unit-mass charge quantity Q/M of the toner in the present embodiment is schematically represented by line graphs each having the same slope. In FIG. 11, the apparent start-up, plotted along the vertical axis, indicates a level of the Q/M of the toner when the toner reaches the apparent start-up condition, and the line graphs T1, T2 and T3 respectively indicate the changes of the unit-mass charge quantity Q/M related to the developing agents the non-driven periods of which are equal to the reference times T1, T2 and T3 shown in FIG. 10.

In the graph T1 (the non-driven period is equal to the reference time T1), as shown in FIG. 11, when the mixing time is increased to an initial mixing time Ns, the Q/M is raised to the apparent start-up level. In the graphs T2 and T3, when the mixing time is at the initial mixing time Ns, the Q/M is not yet raised to the apparent start-up level. In the graph T2 (the non-driven period is equal to the reference time T2), the mixing time of (Ns+N1) (where N1 is a given mixing time) is required for the Q/M to reach the apparent start-up level. In the graph T3 (the non-driven period is equal to the reference time T3), the mixing time of (Ns+2N1) is required for the Q/M to reach the apparent start-up level.

Taking account of the influence of the mixing of the developing agent both for the warm-up period (or the initial mixing time Ns) and for the duration in which the AC bias voltage is continuously supplied to the developing roller 4*a*, the inventors have determined a method of switching of the developing bias voltage (which is described above with reference to FIG. 10) performed by the present embodiment of the image forming apparatus, as follows.

In a case in which the non-driven period "t" of the developing agent is in the region A of FIG. 10, the Q/M in this case reaches the apparent start-up level when the mixing time is increased to the initial mixing time. In the present embodiment, the AC bias voltage $V_{BA}$, indicated in the TABLE 1, is supplied to the developing roller 4*a*, and the switching of the developing bias voltage is not performed.

In a case in which the non-driven period "t" is in the region B of FIG. 10, the AC bias voltage $V_{BB}$, indicated in the TABLE 1, is supplied to the developing roller 4*a*. When a duration in which this AC bias voltage is continuously supplied exceeds a reference mixing time $N_B$, the AC bias voltage $V_{BB}$ is switched to $V_{BA}$ in order to achieve a good image quality despite the rising Q/M of the toner. The reference mixing time $N_B$ is calculated by the formula 1: $N_B = N1 \times (t-T1)/(T2-T1)$.

In a case in which the non-driven period "t" is in the region C of FIG. 10, the AC bias voltage $V_{BC}$, indicated in the TABLE 1, is supplied to the developing roller 4*a*. When a duration in which this AC bias voltage is continuously supplied exceeds a reference mixing time $N_C$, the AC bias voltage $V_{BC}$ is first switched to $V_{BB}$ in order to achieve a good image quality despite the rising Q/M of the toner. Subsequently, when a duration in which the AC bias voltage ($V_{BB}$) is continuously supplied exceeds the given mixing time N1, the AC bias voltage $V_{BB}$ is further switched to $V_{BA}$. That is, the peak-to-peak voltage Vpp of the developing bias voltage at the output of the developing bias supplying unit 18 is increased in order to achieve a good image quality despite the rising Q/M of the toner. The reference mixing time $N_C$ is calculated by the formula 2: $N_C = N1 \times (t-T2)/(T3-T2)$.

In a case in which the non-driven period "t" is in the region D of FIG. 10, the DC bias voltage $V_{BD}$, indicated in the TABLE 1, is supplied to the developing roller 4*a*. As shown in FIG. 10, the Q/M in the region D is very gradually changed in proportion to the non-driven period "t" of the developing agent. When a duration in which the DC bias voltage is continuously supplied exceeds the given reference time $N_D$, the DC bias voltage "$V_{BD}$" is switched to the AC bias voltage "$V_{BC}$". Subsequently, every time the duration of the supply of the AC bias voltage exceeds the given mixing time N1, the developing bias voltage is sequentially switched from "$V_{BC}$" to one of "$V_{BB}$" and "$V_{BA}$" in this order. That is, the peak-to-peak voltage Vpp of the developing bias voltage at the output of the developing bias supplying unit 18 is increased in order to achieve a good image quality despite the rising Q/M of the toner.

The values of the reference time (T1, T2, T3) and the reference mixing time (N1, $N_D$) depend on the kind of the developing agent used by the image forming apparatus. It is necessary that a reference time and a reference mixing time, appropriate for the developing agent used, be predetermined by performing a preliminary measurement. In the present embodiment, the given mixing time N1 is preset to 30 seconds and the given reference time $N_D$ is preset to 10 seconds.

Figure 12:
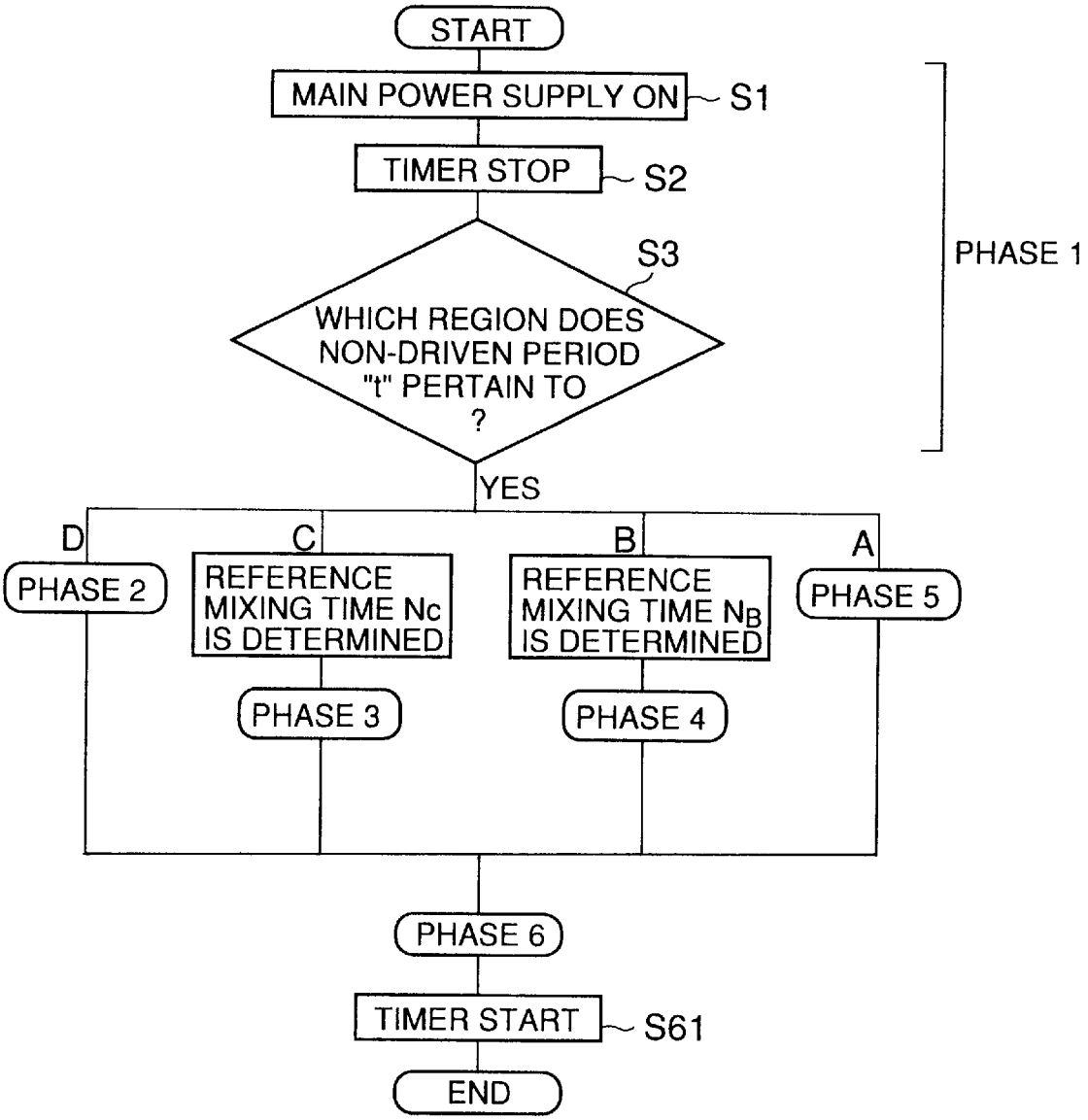
FIG. 12 is a flowchart for explaining a developing bias control process performed by a control unit of the image forming apparatus shown in FIG. 9.

FIG. 12 is a flowchart for explaining a developing bias control process performed by a control unit of the image forming apparatus shown in FIG. 9.

Figure 13:
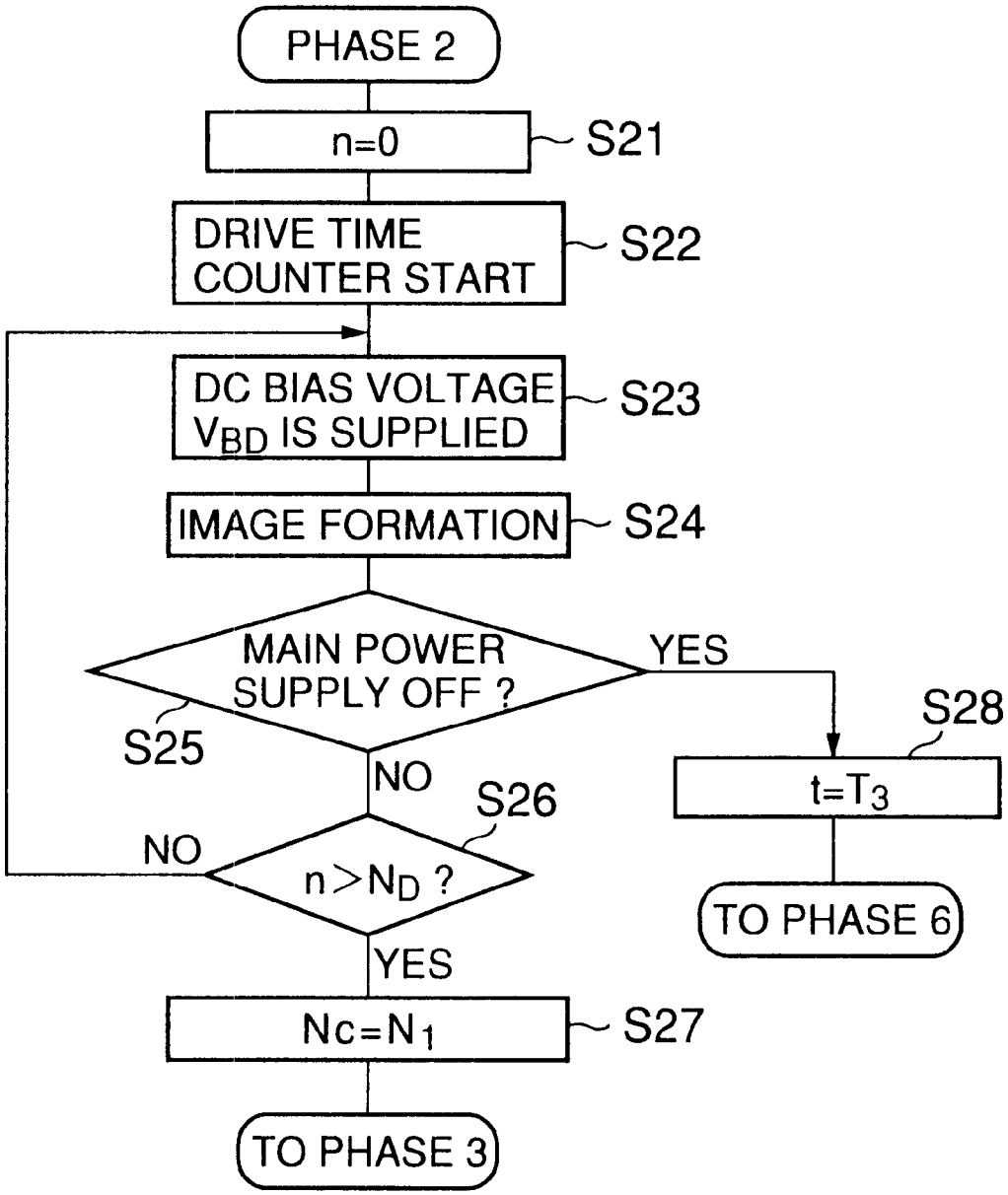
FIG. 13 is a flowchart for explaining a phase 2 of the developing bias control process shown in FIG. 12.
Figure 14:
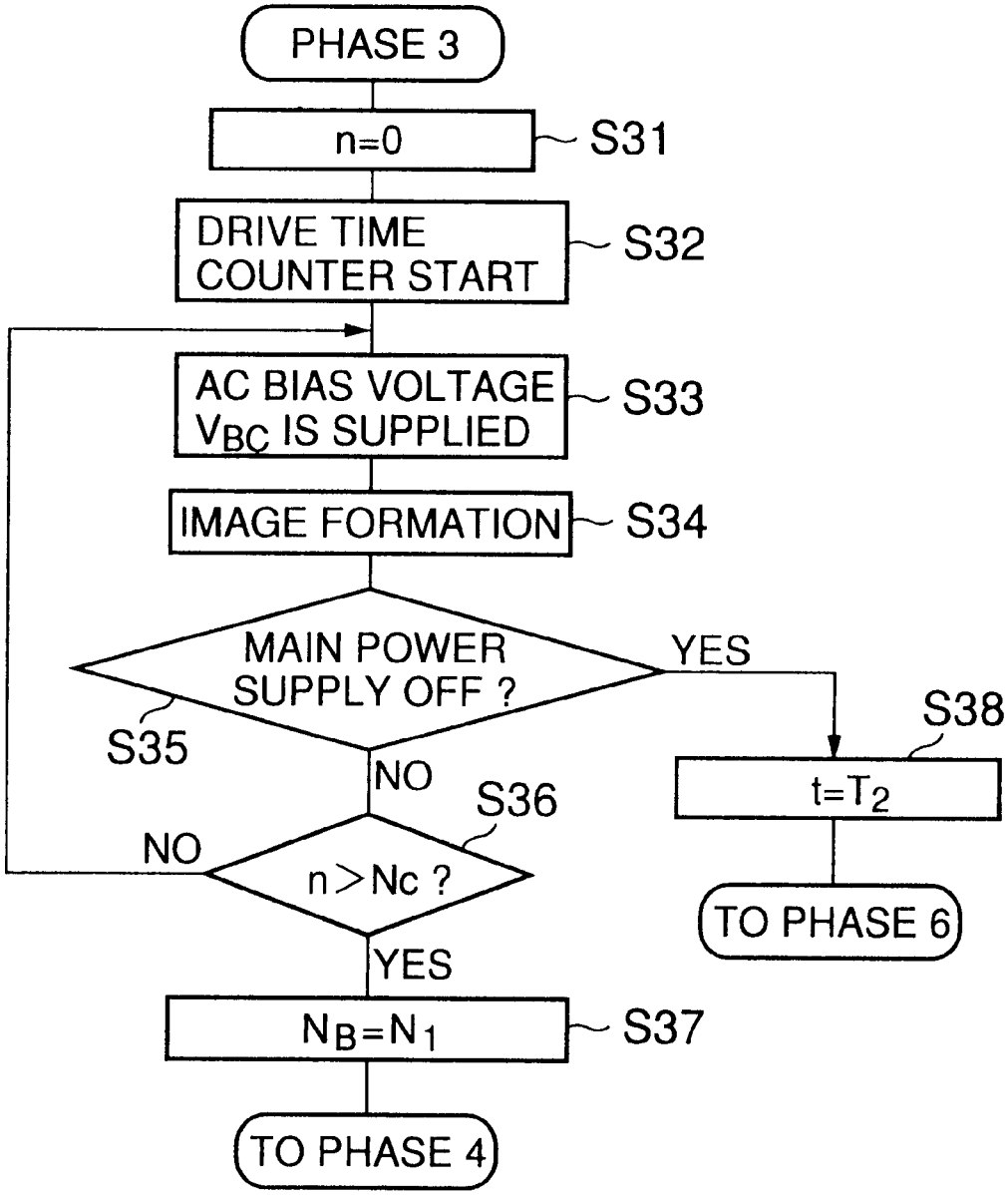
FIG. 14 is a flowchart for explaining a phase 3 of the developing bias control process shown in FIG. 12.
Figure 15:
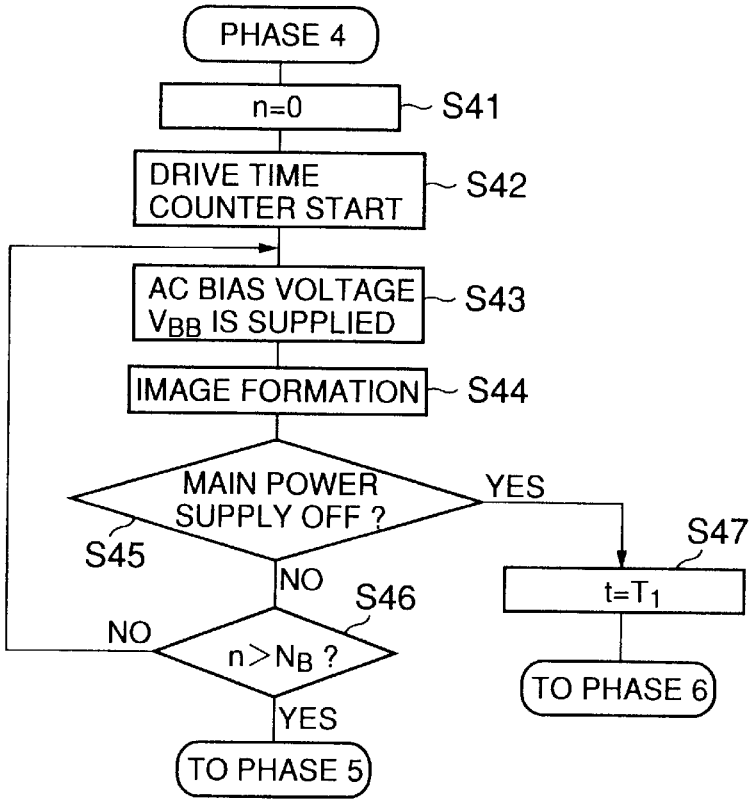
FIG. 15 is a flowchart for explaining a phase 4 of the developing bias control process shown in FIG. 12.
Figure 16:
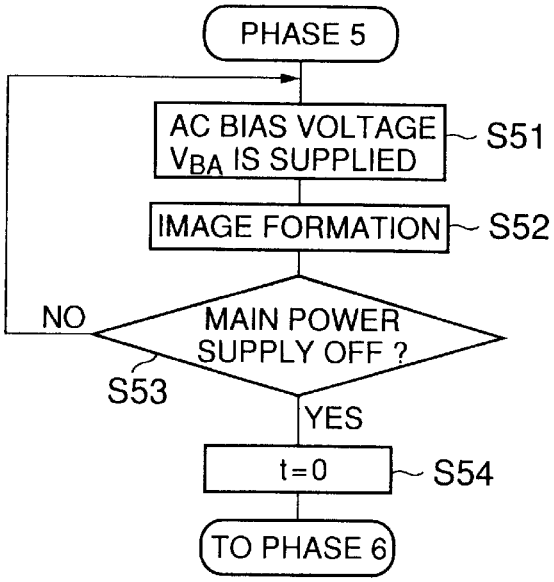
FIG. 16 is a flowchart for explaining a phase 5 of the developing bias control process shown in FIG. 12.

FIG. 13 shows a phase 2 of the developing bias control process shown in FIG. 12. FIG. 14 shows a phase 3 of the developing bias control process shown in FIG. 12. FIG. 15 shows a phase 4 of the developing bias control process shown in FIG. 12. FIG. 16 shows a phase 5 of the developing bias control process shown in FIG. 12.

As shown in FIG. 12, the developing bias control process, performed by the control unit 10*a* in the present embodiment, is constituted by six phases: "Phase 1" through "Phase 6". After one of the "Phase 2" through "Phase 5" is performed, the control unit 10*a* proceeds to the "Phase 6".

At the start of the developing bias control process of FIG. 12, the control unit 10*a* at step S1 detects that the main power supply 12 is ON. After the step S1 is performed, the control unit 10*a* at step S2 turns OFF the timer 11 to stop counting the non-driven period of the developing agent 5. The control unit 10*a* at this time reads the non-driven period "t" measured by the timer 11. After the step S2 is performed, the control unit 10*a* at step S3 makes a determination as to which of the regions A through D the measured non-driven period "t" pertains to. When the result at the step S3 is the region D, the control unit 10*a* proceeds to the "Phase 2" (FIG. 13). When the result at the step S3 is the region C, the control unit 10*a* determines the reference mixing time $N_C$ based on the measured non-driven period "t" (the above formula 2), and proceeds to the "Phase 3" (FIG. 14). When the result at the step S3 is the region B, the control unit 10*a* determines a reference mixing time $N_B$ based on the measured non-driven period "t" (the above formula 1), and proceeds to the "Phase 4" (FIG. 15). When the result at the step S3 is the region A, the control unit 10*a* proceeds to the "Phase 5" (FIG. 16).

The above-described steps S1 through S3 are included in the "Phase 1" of the developing bias control process shown in FIG. 12.

Referring to FIG. 13, a description will now be given of the phase 2 of the developing bias control process shown in FIG. 12.

When the non-driven period "t" is in the region D, the control unit 10*a* at step S21 resets the drive time counter 13 so that the drive time "n" is initialized to 0 (n=0). After the step S21 is performed, the control unit 10*a* at step S22 turns ON the drive time counter 13 to start counting the drive time "n" of the developing roller 4*a*. After the step S22 is performed, the control unit 10*a* at step S23 modulates the peak-to-peak voltage Vpp of the AC bias voltage at the output of the developing bias supplying unit 18 so that the DC bias voltage $V_{BD}$ is supplied to the developing roller 4*a*. After the step S23 is performed, the control unit 10*a* at step S24 performs a current cycle of image formation. After the step S24 is performed, the control unit 10*a* at step S25 makes a determination as to whether the main power supply 12 is turned OFF during the supply of the DC bias voltage to the developing roller 4*a*.

When the result at the step S25 is affirmative (the main power supply 12 is OFF), the control unit 10*a* at step S28 sets the timer 11 at the reference time T3 (t=T3). After the step S28 is performed, the control unit 10*a* proceeds to the "Phase 6".

When the result at the step S25 is negative (the main power supply 12 is ON), the control unit 10*a* at step S26 makes a determination as to whether the drive time "n" output by the drive time counter 13 exceeds the given reference time "$N_D$". When the result at the step S26 is negative ($n \leqq N_D$), the control unit 10*a* repeats the above step S23. When the result at the step S26 is afirmative ($n > N_D$), the control unit 10*a* step S27 sets the reference mixing time $N_C$ to be equal to the given mixing time N1 ($N_C$=N1). The given mixing time N1 is preset to, for example, 30 seconds. After the step S27 is performed, the control unit 10*a* proceeds to the "Phase 3" (FIG. 14).

The above steps S21 through S28 are included in the "Phase 2" of the developing bias control process shown in FIG. 12.

Referring to FIG. 14, a description will now be given of the phase 3 of the developing bias control process shown in FIG. 12.

When the non-driven period "t" is in the region C, the control unit 10*a* at step S31 resets the drive time counter 13 so that the drive time "n" is initialized to 0 (n=0). After the step S31 is performed, the control unit 10*a* at step S32 turns ON the drive time counter 13 to start counting the drive time "n" of the developing roller 4*a*. After the step S32 is performed, the control unit 10*a* at step S33 modulates the peak-to-peak voltage Vpp of the AC bias voltage at the output of the developing bias supplying unit 18 so that the AC bias voltage $V_{BC}$ is supplied to the developing roller 4*a*. After the step S33 is performed, the control unit 10*a* at step S34 performs a current cycle of image formation. After the step S34 is performed, the control unit 10*a* at step S35 makes a determination as to whether the main power supply 12 is turned OFF during the supply of the AC bias voltage to the developing roller 4*a*.

When the result at the step S35 is affirmative (the main power supply 12 is OFF), the control unit 10*a* at step S38 sets the timer 11 at the reference time T2 (t=T2). After the step S38 is performed, the control unit 10*a* proceeds to the "Phase 6".

When the result at the step S35 is negative (the main power supply 12 is ON), the control unit 10*a* at step S36 makes a determination as to whether the drive time "n" output by the drive time counter 13 exceeds the reference mixing time "$N_C$". When the result at the step S36 is negative ($n \leqq N_C$), the control unit 10*a* repeats the above step S33. When the result at the step S36 is affirmative ($n > N_C$), the control unit 10*a* at step S37 sets the reference mixing time $N_B$ to be equal to the given mixing time N1 ($N_B$=N1). After the step S37 is performed, the control unit 10*a* proceeds to the "Phase 4" (FIG. 15).

The above steps S31 through S38 are included in the "Phase 3" of the developing bias control process shown in FIG. 12.

Referring to FIG. 15, a description will now be given of the phase 4 of the developing bias control process shown in FIG. 12.

When the non-driven period "t" is in the region B, the control unit 10*a* at step S41 resets the drive time counter 13 so that the drive time "n" is initialized to 0 (n=0). After the step S41 is performed, the control unit 10*a* at step S42 turns ON the drive time counter 13 to start counting the drive time "n" of the developing roller 4*a*. After the step S42 is performed, the control unit 10*a* at step S43 modulates the peak-to-peak voltage Vpp of the AC bias voltage at the output of the developing bias supplying unit 18 so that the AC bias voltage $V_{BB}$ is supplied to the developing roller 4*a*. After the step S43 is performed, the control unit 10*a* at step S44 performs a current cycle of image formation. After the step S44 is performed, the control unit 10*a* at step S45 makes a determination as to whether the main power supply 12 is turned OFF during the supply of the AC bias voltage to the developing roller 4*a*.

When the result at the step S45 is affirmative (the main power supply 12 is OFF), the control unit 10*a* at step S47 sets the timer 11 at the reference time T1 (t=T1). After the step S47 is performed, the control unit 10*a* proceeds to the "Phase 6".

When the result at the step S45 is negative (the main power supply 12 is ON), the control unit 10*a* at step S46 makes a determination as to whether the drive time "n" output by the drive time counter 13 exceeds the reference mixing time "$N_B$". When the result at the step S46 is negative ($n \leqq N_B$), the control unit 10*a* repeats the above step S43. When the result at the step S46 is affirmative ($n > N_B$), the control unit 10*a* proceeds to the "Phase 5" (FIG. 16).

The above steps S41 through S47 are included in the "Phase 4" of the developing bias control process shown in FIG. 12.

Referring to FIG. 16, a description will now be given of the phase 5 of the developing bias control process shown in FIG. 12.

When the non-driven period "t" is in the region A, the control unit 10*a* at step S51 modulates the peak-to-peak voltage Vpp of the AC bias voltage at the output of the developing bias supplying unit 18 so that the AC bias voltage $V_{BA}$ is supplied to the developing roller 4*a*. After the step S51 is performed, the control unit 10*a* at step S52 performs a current cycle of image formation. After the step S52 is performed, the control unit 10*a* at step S53 makes a determination as to whether the main power supply 12 is turned OFF during the supply of the AC bias voltage to the developing roller 4*a*.

When the result at the step S53 is affirmative (the main power supply 12 is OFF), the control unit 10*a* at step S54 resets the timer 11 to zero (t=0). After the step S54 is performed, the control unit 10*a* proceeds to the "Phase 6" (FIG. 12).

When the result at the step S53 is negative (the main power supply 12 is ON), the control unit 10*a* repeats the above step S51.

The above steps S51 through S54 are included in the "Phase 5" of the developing bias control process shown in FIG. 12.

Referring back to FIG. 12, after one of the phase 2 through the phase 5 is performed, the control unit 10*a* at step S61 turns ON the timer 11 to start counting the non-driven period "t" of the developing agent 5. After the step S61 is performed, the developing bias control process of FIG. 12 ends.

Only the above step S61 is included in the "Phase 6" of the developing bias control process shown in FIG. 12.

In the present embodiment, when a duration in which the AC bias voltage is continuously supplied to the developing roller 4*a* (which duration is equivalent to the drive time "n" measured by the drive time counter 13) exceeds a reference mixing time (which is one of the reference mixing times $N_B$ and $N_C$ and the reference time $N_D$), the control unit 10*a* controls the AC bias voltage at the output of the developing bias supplying unit 18 in a secondary manner that the peak-to-peak voltage Vpp of the AC bias voltage supplied to the developing roller 4*a* is increased.

Further, in the present embodiment, the control unit 10*a* determines a reference mixing time (one of the reference mixing times $N_B$ and $N_C$) based on the non-driven period "t" measured by the timer 11. When the duration (or the drive time "n" of the developing roller 4*a*) in which the AC bias voltage is continuously supplied to the developing roller 4*a* does not exceed the reference mixing time, the control unit 10*a* controls the AC bias voltage in a primary manner that the peak-to-peak voltage of the AC bias voltage supplied to the developing agent support is decreased in proportion to the measured non-driven period, as shown in FIG. 10. Further, every time the above-mentioned duration exceeds the reference mixing time, the control unit 10*a* controls the AC bias voltage in the secondary manner that the peak-to-peak voltage Vpp of the AC bias voltage supplied to the developing roller 4*a* is increased.

Further, in the present embodiment, the control unit 10*a* performs the switching of the bias voltage control to the secondary manner at the beginning of a next cycle of image formation in order to avoid the switching during a current cycle of image formation.

Figure 17:
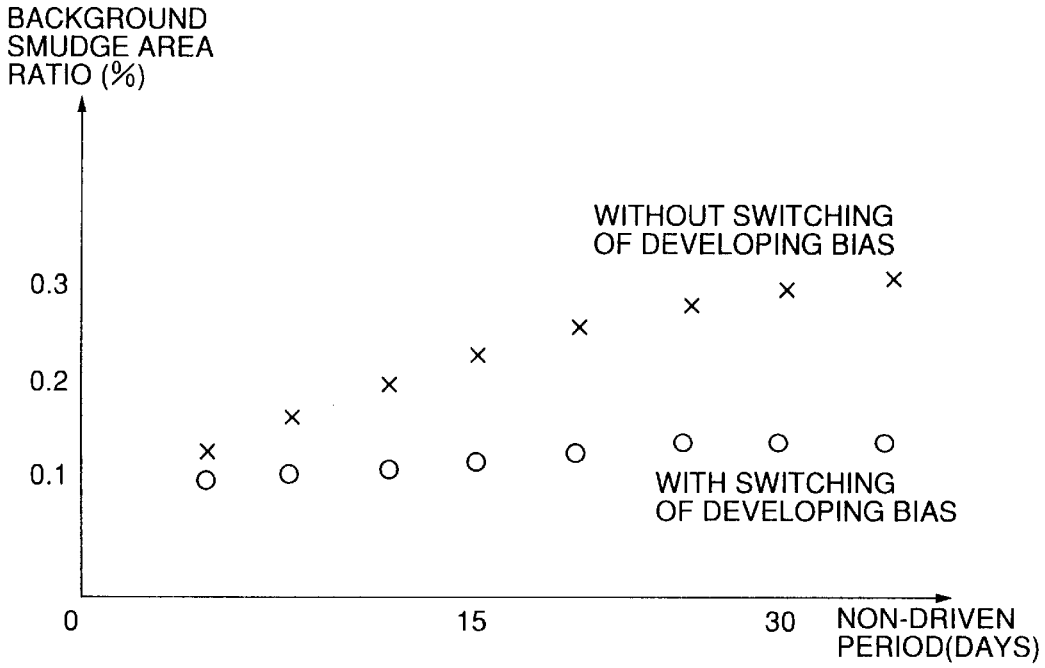
FIG. 17 is a diagram for explaining a relationship between the non-driven period and the background smudge area ratio when the switching of one of various developing bias voltages to the next one is performed.

FIG. 17 is a diagram for explaining a relationship between the non-driven period and the background smudge area ratio when the switching of one of the developing bias voltages ("$V_{BA}$", "$V_{BB}$", "$V_{BC}$" and "$V_{BD}$") to the next one is performed.

In FIG. 17, the non-driven period, plotted along the lateral axis, indicates a period (or the number of days) in which the developing agent is continuously held in the non-driven condition following the time the latest start-up of the developing agent was achieved. The background smudge area ratio, plotted along the vertical axis, indicates an estimated ratio (%) of the background smudge area to the entire image area in the copy. The background smudge area ratio has been measured from sample copies through an experiment performed by the inventors.

Further, in FIG. 17, a relationship between the non-driven period and the background smudge area ratio when the switching is not performed, is illustrated for the purpose of comparison. Hereinafter, the relationship when the above-mentioned switching is not performed is called the "without switching" case, and the relationship when the above-mentioned switching is performed according to the present embodiment is called the "with switching" case.

As shown in FIG. 17, with respect to all the developing agents which have been held in the non-driven condition for various days after the time of the latest start-up, the background smudge area ratio is remarkably lower in the "with switching" case than in the "without switching" case. Hence, the image forming apparatus of the present embodiment is effective in preventing occurrence of a background smudge in the copy at an initial time of image formation after the developing agent was held in a non-driven condition over an extended period. Therefore, it is possible for the image forming apparatus of the present embodiment to provide not only a speedy image formation but also a good image quality at the initial time of image formation.

Further, the present invention is not limited to the above-described embodiments, and variations and modifications may be made without departing from the scope of the present invention.

What is claimed is:

1. An image forming apparatus comprising:

an image support for supporting an electrostatic latent image on a surface of the image support;

a developing unit having a developing agent support, the developing agent support retaining a developing agent, including a toner and carriers, contained in the developing unit, and the developing unit converting the latent image on the image support into a toner image by causing the toner to adhere to the surface of the image support;

a developing bias supplying unit for supplying a developing bias voltage to the developing agent support of the developing unit, the developing bias voltage being one of a DC bias voltage and an AC bias voltage;

a timer for measuring a non-driven period of the developing agent in the developing unit; and a control unit for selecting one of the DC bias voltage and the AC bias voltage from the developing bias supplying unit based on the non-driven period measured by the timer, and for controlling the developing bias voltage at an output of the developing bias supplying unit such that the selected one of the DC bias voltage and the AC bias voltage is supplied to the developing agent support.

2. The image forming apparatus according to claim 1, wherein, when the measured non-driven period is longer than a given reference time, the control unit switches the developing bias voltage at the output of the developing bias supplying unit to the DC bias voltage so as to supply the DC bias voltage to the developing agent support, and, when the measured non-driven period is not longer than the reference time, the control unit switches the developing bias voltage to the AC bias voltage so as to supply the AC bias voltage to the developing agent support.

3. The image forming apparatus according to claim 2, further comprising a drive time counter for counting a drive time of the developing agent support, and for outputting the counted drive time to the control unit, wherein, when a duration in which the DC bias voltage is continuously supplied to the developing agent support exceeds a given reference drive time, the control unit switches the developing bias voltage at the output of the developing bias supplying unit to the AC bias voltage so as to supply the AC bias voltage to the developing agent support.

4. The image forming apparatus according to claim 3, wherein the control unit performs switching of the developing bias voltage from the DC bias voltage to the AC bias voltage at the beginning of a next cycle of image formation in order to avoid the switching during a current cycle of image formation.

5. The image forming apparatus according to claim 2, wherein the control unit performs switching of the developing bias voltage from the DC bias voltage to the AC bias voltage at the beginning of a next cycle of image formation in order to avoid the switching during a current cycle of image formation.

6. An image forming apparatus comprising:

an image support for supporting an electrostatic latent image on a surface of the image support;

a developing unit having a developing agent support, the developing agent support retaining a developing agent, including a toner and carriers, contained in the developing unit, and the developing unit converting the latent image on the image support into a toner image by causing the toner to adhere to the surface of the image support;

a developing bias supplying unit for supplying a variable AC bias voltage to the developing agent support of the developing unit;

a timer for measuring a non-driven period of the developing agent in the developing unit; and a control unit for controlling the AC bias voltage at an output of the developing bias supplying unit based on the non-driven period measured by the timer, such that a peak-to-peak voltage of the AC bias voltage supplied to the developing agent support is decreased in proportion to the measured non-driven period.

7. The image forming apparatus according to claim 6, further comprising a drive time counter for counting a drive time of the developing agent support, and for outputting the counted drive time to the control unit, wherein, when a duration in which the AC bias voltage is continuously supplied to the developing agent support exceeds a reference mixing time, the control unit controls the AC bias voltage at the output of the developing bias supplying unit in a secondary manner that the peak-to-peak voltage of the AC bias voltage supplied to the developing agent support is increased.

8. The image forming apparatus according to claim 7, wherein the control unit determines a reference mixing time based on the non-driven period measured by the timer, and, when the duration in which the AC bias voltage is continuously supplied to the developing agent support does not exceed the reference mixing time, the control unit controls the AC bias voltage in a primary manner that the peak-to-peak voltage of the AC bias voltage supplied to the developing agent support is decreased in proportion to the measured non-driven period, and, every time the duration exceeds the reference mixing time, the control unit controls the AC bias voltage in the secondary manner that the peak-to-peak voltage of the AC bias voltage supplied to the developing agent support is increased.

9. The image forming apparatus according to claim 8, wherein the control unit performs the switching of the bias voltage control to the secondary manner at the beginning of a next cycle of image formation in order to avoid the switching during a current cycle of image formation.

10. The image forming apparatus according to claim 7, wherein the control unit performs the switching of the bias voltage control to the secondary manner at the beginning of a next cycle of image formation in order to avoid the switching during a current cycle of image formation.

* * * * *